US012577718B2

(12) United States Patent
Lee et al.

(10) Patent No.: US 12,577,718 B2
(45) Date of Patent: Mar. 17, 2026

(54) WASHING MACHINE AND METHOD OF CONTROLLING THE SAME

(71) Applicant: SAMSUNG ELECTRONICS CO., LTD., Suwon-si (KR)

(72) Inventors: Sungmo Lee, Suwon-si (KR); Junhyun Park, Suwon-si (KR); Sungjong Kim, Suwon-si (KR); Seunghoon Kim, Suwon-si (KR); Haneal Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 205 days.

(21) Appl. No.: 18/340,526

(22) Filed: Jun. 23, 2023

(65) Prior Publication Data

US 2024/0068146 A1 Feb. 29, 2024

Related U.S. Application Data

(63) Continuation of application No. PCT/KR2023/007888, filed on Jun. 8, 2023.

(30) Foreign Application Priority Data

Aug. 25, 2022 (KR) ..... 10-2022-0107124

(51) Int. Cl.
*D06F 23/02* (2006.01)
*D06F 23/04* (2006.01)
(Continued)

(52) U.S. Cl.
CPC ..... *D06F 33/40* (2020.02); *D06F 23/02* (2013.01); *D06F 23/04* (2013.01); *D06F 33/48* (2020.02);
(Continued)

(58) Field of Classification Search
CPC ..... D06F 33/48; D06F 34/16; D06F 2103/26
See application file for complete search history.

(56) References Cited

U.S. PATENT DOCUMENTS 7,788,755 B2 9/2010 Lee et al.
8,601,626 B2 12/2013 Kim et al.
(Continued)

FOREIGN PATENT DOCUMENTS

EP 2330244 A1 6/2011
JP 2009-100985 A 5/2009
(Continued)

OTHER PUBLICATIONS

JP2010035953A Machine Translation (Year: 2010).*
(Continued)

*Primary Examiner* — Spencer E. Bell

(57) ABSTRACT

A washing machine includes: a cabinet on a front side thereof with an inlet through which laundry is input; a tub inside the cabinet and having an opening corresponding to the inlet; a drum rotatably inside the tub; a motor configured to provide power for rotating the drum; a first vibration sensor configured to detect vibration generated from the tub; a second vibration sensor configured to detect vibration generated from the cabinet; and at least one processor. The at least one processor is configured to perform a spin-drying process according to a spin-drying profile defined by a rotational speed of the drum, and to control rotation of the drum based on a first vibration value corresponding to an output of the first vibration sensor and a second vibration value corresponding to an output of the second vibration sensor during a spin-drying process.

10 Claims, 18 Drawing Sheets

(51) Int. Cl.

| | |
|---|---|
| ***D06F 33/40*** | (2020.01) |
| ***D06F 33/48*** | (2020.01) |
| ***D06F 34/16*** | (2020.01) |
| ***D06F 34/20*** | (2020.01) |
| ***D06F 37/30*** | (2020.01) |
| ***D06F 39/12*** | (2006.01) |
| ***D06F 103/26*** | (2020.01) |
| ***D06F 105/48*** | (2020.01) |

(52) U.S. Cl.
CPC ..... *D06F 34/16* (2020.02); *D06F 34/20* (2020.02); *D06F 37/304* (2013.01); *D06F 39/125* (2013.01); *D06F 2103/26* (2020.02); *D06F 2105/48* (2020.02)

(56) References Cited

U.S. PATENT DOCUMENTS

| | | | |
|---|---|---|---|
| 10,266,982 | B2 | 4/2019 | Hoppe et al. |
| 11,293,127 | B2 | 4/2022 | Kwon et al. |
| 2012/0073062 | A1 | 3/2012 | Farid et al. |

FOREIGN PATENT DOCUMENTS

| | | | |
|---|---|---|---|
| JP | 2010-035953 | A | 2/2010 |
| JP | 2010069293 | A | 4/2010 |
| JP | 4867631 | B2 | 2/2012 |
| JP | 2016-137091 | A | 8/2016 |
| JP | 2020188970 | A | 11/2020 |
| KR | 10-2007-0031726 | A | 3/2007 |
| KR | 10-2010-0019093 | A | 2/2010 |
| KR | 10-2010-0038702 | A | 4/2010 |
| KR | 10-2010-0082448 | A | 7/2010 |
| KR | 20100082584 | A | 7/2010 |
| KR | 10-1054431 | B1 | 8/2011 |
| KR | 10-1219368 | B1 | 1/2013 |
| KR | 2019-0094012 | A | 8/2019 |
| KR | 10-2019-0104279 | A | 9/2019 |
| KR | 10-2304812 | B1 | 9/2021 |
| WO | 2020159119 | A1 | 8/2020 |

OTHER PUBLICATIONS

International Search Report and Written Opinion of the International Searching Authority dated Oct. 4, 2023, in connection with International Application No. PCT/KR2023/007888, 9 pages.

Supplementary European Search Report dated Jul. 18, 2025, in connection with European Patent Application No. 23857502.1, 12 pages.

* cited by examiner

FIG. 7

| SECTION | FIRST SECTION | SECOND SECTION | THIRD SECTION | FOURTH SECTION |
|---|---|---|---|---|
| ROTATIONAL SPEED | 500rpm | 800rpm | 950rpm | 1100rpm |

HARD FLOOR & LEG BALANCED

HARD FLOOR & LEG UNBALANCED

Soft Floor

WASHING MACHINE AND METHOD OF CONTROLLING THE SAME

CROSS-REFERENCE TO RELATED APPLICATIONS

This application is a bypass continuation of International Application No. PCT/KR2023/007888, filed Jun. 8, 2023, which claims priority to Korean Patent Application No. 10-2022-0107124, filed Aug. 25, 2022, the disclosures of which are herein incorporated by reference in their entirety.

BACKGROUND

1. Field

The disclosure relates to a washing machine capable of performing a washing process and a spin-drying process on laundry, and a method of controlling the same.

2. Description of Related Art

In general, a washing machine may include a tub accommodating water for washing and a drum rotatably installed in the tub. In addition, the washing machine may wash laundry by rotating the drum containing laundry.

Laundry may be put into the drum through an inlet formed in a main body, and the inlet formed in the main body may be opened or closed by a door.

A washing machine performs a washing cycle including a series of operations, such as a washing process of removing contamination from laundry with detergent-dissolved water, a rinsing process of rinsing lather and residual detergent from laundry with detergent-free water, and a spin-drying process of spin-drying laundry at a high speed.

SUMMARY

A washing machine according to an embodiment includes: a cabinet provided with an inlet through which laundry is input; a tub provided inside the cabinet; a drum rotatably provided inside the tub; a motor configured to provide power for rotating the drum; a first vibration sensor configured to detect vibration generated from the tub; a second vibration sensor configured to detect vibration generated from the cabinet; and at least one processor.

The at least one processor may be configured to control rotation of the drum based on a first vibration value corresponding to an output of the first vibration sensor and a second vibration value corresponding to an output of the second vibration sensor during a spin-drying process.

A method of controlling a washing machine according to an embodiment includes performing a spin-drying process according to a spin-dry profile defined by a rotational speed of a drum.

The method may further include acquiring a first vibration value from a first vibration sensor configured to detect vibration generated from the tub during a spin-drying process; and acquiring a second vibration value from a second vibration sensor configured to detect vibration generating from the cabinet.

The method may further include controlling rotation of the drum based on the first vibration value and the second vibration value.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

FIG. 7 is a table showing an example of a vibration detecting section in which a washing machine detects vibration during a spin-drying process according to an embodiment.

DETAILED DESCRIPTION

Figure 1:
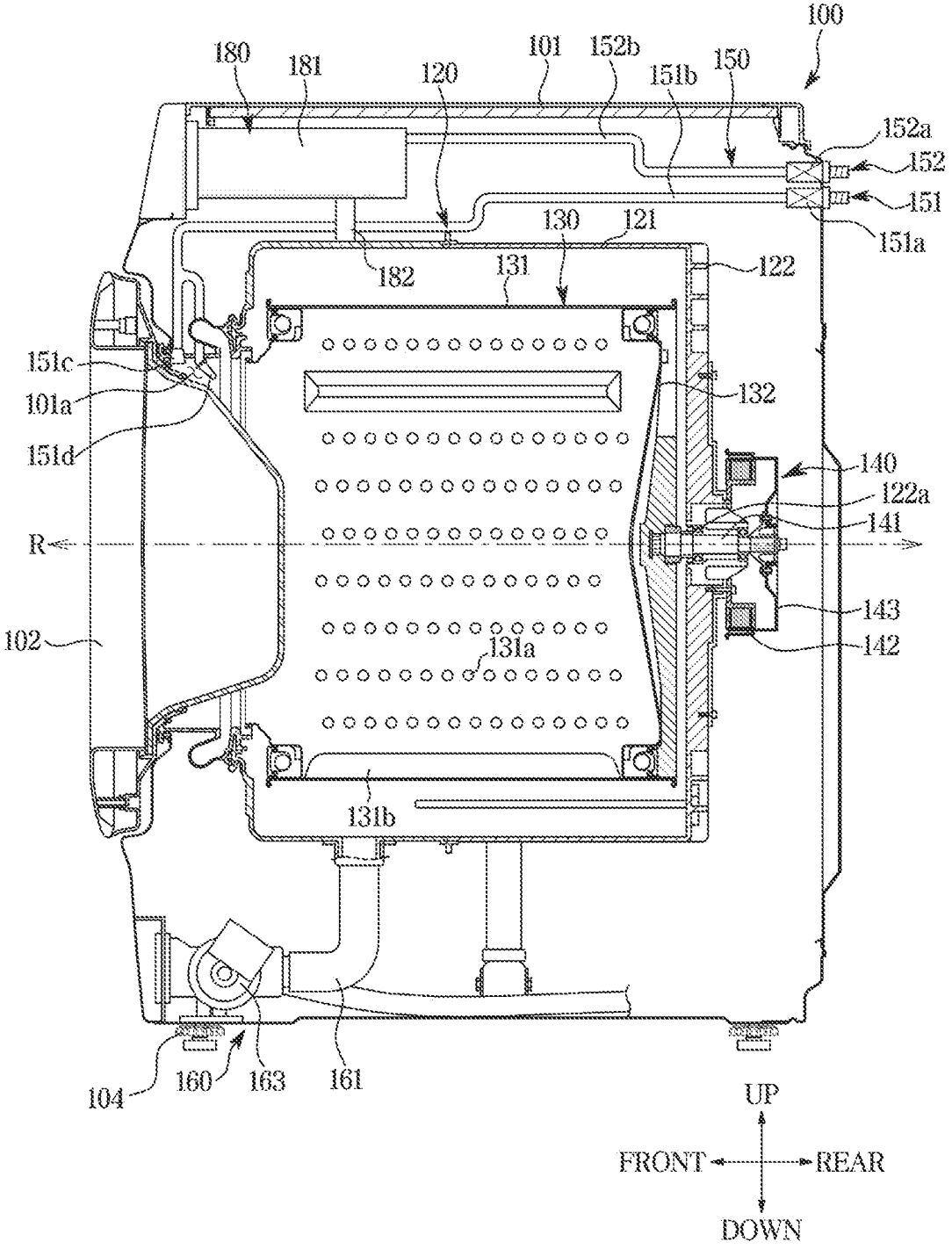
FIG. 1 illustrates a side cross-sectional view of a configuration of a washing machine according to an embodiment.

FIGS. 1 through 18, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments disclosed in the present specification and the components shown in the drawings are merely embodiments of the disclosed disclosure and various modifications capable of replacing the embodiments and drawings of the present specification may be formed at the time of filing the present application.

Further, terms used herein are used to illustrate the embodiments and are not intended to limit and/or to restrict the disclosed disclosure. As used herein, singular forms are intended to include plural forms as well, unless the context clearly indicates otherwise.

Terms "comprise," "is provided with," "have," and the like are used herein to specify the presence of stated features, numerals, steps, operations, components, parts or combinations thereof but do not preclude the presence or addition of one or more other features, numerals, steps, operations, components, parts, or combinations thereof.

Further, terms such as "unit," "portion," "block," "member," "module" may refer to a unit of processing at least one function or operation. For example, these terms may refer to a hardware component, such as a field-programmable gate array (FPGA)/an application-specific integrated circuit (ASIC), a software component, or at least one process processed by a processor.

In addition, the ordinal numbers, such as "first~" and "second~" used in front of the components described in the specification are only used to distinguish the components from each other without having other meanings, such as the order of connection and use between the components, priority, etc.

A reference numeral attached in each of operations is used to identify each of the operations, and this reference numeral does not describe the order of the operations, and the operations may be performed differently from the described order unless clearly specified in the context.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

A washing machine according to an embodiment includes: a cabinet provided on a front side thereof with an inlet through which laundry is input; a tub provided inside the cabinet and having an opening corresponding to the inlet; a drum rotatably provided inside the tub; a motor configured to provide power for rotating the drum; a first vibration sensor configured to detect vibration generated from the tub; a second vibration sensor configured to detect vibration generated from the cabinet; and at least one processor.

The at least one processor may be configured to perform a spin-drying process according to a spin-drying profile defined by a rotational speed of the drum, and control rotation of the drum based on a first vibration value corresponding to an output of the first vibration sensor and a second vibration value corresponding to an output of the second vibration sensor during a spin-drying process.

The at least one processor may be configured to compare a reference value corresponding to the first vibration value with the second vibration value, and based on the second vibration value exceeding the reference value, control at least one of a rotation speed or a rotation time of the drum to reduce vibration.

The at least one processor may be configured to compare a first reference value corresponding to the first vibration value with the second vibration value in a first section among a plurality of sections constituting the spin-dry profile, and based on the second vibration value exceeding the first reference value, control a maximum rotational speed (e.g., upper limit of rotational speed) of the drum during the spin-drying process to be lower (i.e., less) than a maximum rotation speed of the drum according to the spin-dry profile.

The at least one processor may be configured to compare a first reference value corresponding to the first vibration value with the second vibration value in a first section among a plurality of sections constituting the spin-dry profile, and based on the second vibration value exceeding the first reference value, maintain the rotational speed of the drum at a current rotation speed.

The at least one processor may be configured to compare a second reference value corresponding to the first vibration value with the second vibration value in a second section among a plurality of sections constituting the spin-dry profile, and based on the second vibration value exceeding the second reference value, increase the rotational speed of the drum to be higher than or equal to a threshold value.

The at least one processor may be configured to compare a second reference value corresponding to the first vibration value with the second vibration value in a second section among a plurality of sections constituting the spin-dry profile, and based on the second vibration value exceeding the second reference value, increase acceleration until the rotational speed of the drum reaches a maximum rotational speed (e.g., upper limit of rotational speed).

The washing machine may further include a plurality of legs provided on a lower side of the cabinet to support the cabinet, wherein the at least one processor may be configured to compare a first reference value corresponding to the first vibration value with the second vibration value in a first section among a plurality of sections constituting the spin-dry profile, and based on the second vibration value exceeding the first reference value, identify that the plurality of legs are in an unbalanced state.

The at least one processor may be configured to compare a second reference value corresponding to the first vibration value with the second vibration value in a second section among a plurality of sections constituting the spin-dry profile, and based on the second vibration value exceeding the second reference value, identify that a floor on which the washing machine is located is a soft floor.

The at least one processor may be configured to compare a first reference value corresponding to the first vibration value with the second vibration value in a first section among a plurality of sections constituting the spin-dry profile, and based on the second vibration value exceeding the first reference value and being less than or equal to a fifth reference value, control a maximum rotational speed of the drum during the spin-drying process to be lower than a maximum rotation speed according to the spin-dry profile.

The at least one processor may be configured to compare a first reference value corresponding to the first vibration value with the second vibration value in a first section among a plurality of sections constituting the spin-dry profile, and based on the second vibration value exceeding the fifth reference value, maintain the rotational speed of the drum at a current rotation speed and then terminate the spin-drying process.

At least one of the first vibration sensor or the second vibration sensor may be implemented as a MicroElectro-Mechanical System (MEMS) sensor.

A method of controlling a washing machine according to an embodiment may include a spin-drying process according to a spin-dry profile defined by a rotational speed of a drum.

The method may further include: acquiring a first vibration value from a first vibration sensor configured to detect vibration generated from the tub during a spin-drying process; and acquiring a second vibration value from a second vibration sensor configured to detect vibration generating from the cabinet.

The method may further include controlling rotation of the drum based on the first vibration value and the second vibration value.

The controlling of the rotation of the drum may include comparing a reference value corresponding to the first vibration value with the second vibration value, and based on the second vibration value exceeding the reference value, controlling at least one of a rotation speed or a rotation time of the drum to reduce vibration.

The controlling of the rotation of the drum may include comparing a first reference value corresponding to the first vibration value with the second vibration value in a first section among a plurality of sections constituting the spin-dry profile, and based on the second vibration value exceeding the first reference value, control a maximum rotational speed of the drum during the spin-drying process to be lower than a maximum rotation speed according to the spin-dry profile.

The controlling of the rotation of the drum may include comparing a first reference value corresponding to the first vibration value with the second vibration value in a first section among a plurality of sections constituting the spin-dry profile, and based on the second vibration value exceeding the first reference value, maintaining the rotational speed of the drum at a current rotation speed.

The controlling of the rotation of the drum may include comparing a second reference value corresponding to the first vibration value with the second vibration value in a second section among a plurality of sections constituting the spin-dry profile, and based on the second vibration value exceeding the second reference value, increasing the rotational speed of the drum to be 1 higher than or equal to a threshold value.

The controlling of the rotation of the drum may include comparing a first reference value corresponding to the first vibration value with the second vibration value in a first section among a plurality of sections constituting the spin-dry profile, and based on the second vibration value exceeding the first reference value, identifying that the plurality of legs are in an unbalanced state.

The controlling of the rotation of the drum may include comparing a second reference value corresponding to the first vibration value with the second vibration value in a second section among a plurality of sections constituting the spin-dry profile, and based on the second vibration value exceeding the second reference value, identifying that a floor on which the washing machine may be located may be a soft floor.

The controlling of the rotation of the drum may include comparing a first reference value corresponding to the first vibration value with the second vibration value in a first section among a plurality of sections constituting the spin-dry profile, and based on the second vibration value exceeding the first reference value and being less than or equal to a fifth reference value, controlling a maximum rotational speed of the drum during the spin-drying process to be lower than a maximum rotation speed according to the spin-dry profile.

The controlling of the rotation of the drum may include comparing a first reference value corresponding to the first vibration value with the second vibration value in a first section among a plurality of sections constituting the spin-dry profile, and based on the second vibration value exceeding the fifth reference value, maintaining the rotational speed of the drum at a current rotation speed and then terminating the spin-drying process.

Hereinafter, an embodiment of a washing machine and a method of controlling the same according to an aspect will be described in detail with reference to the accompanying drawings.

Figure 2:
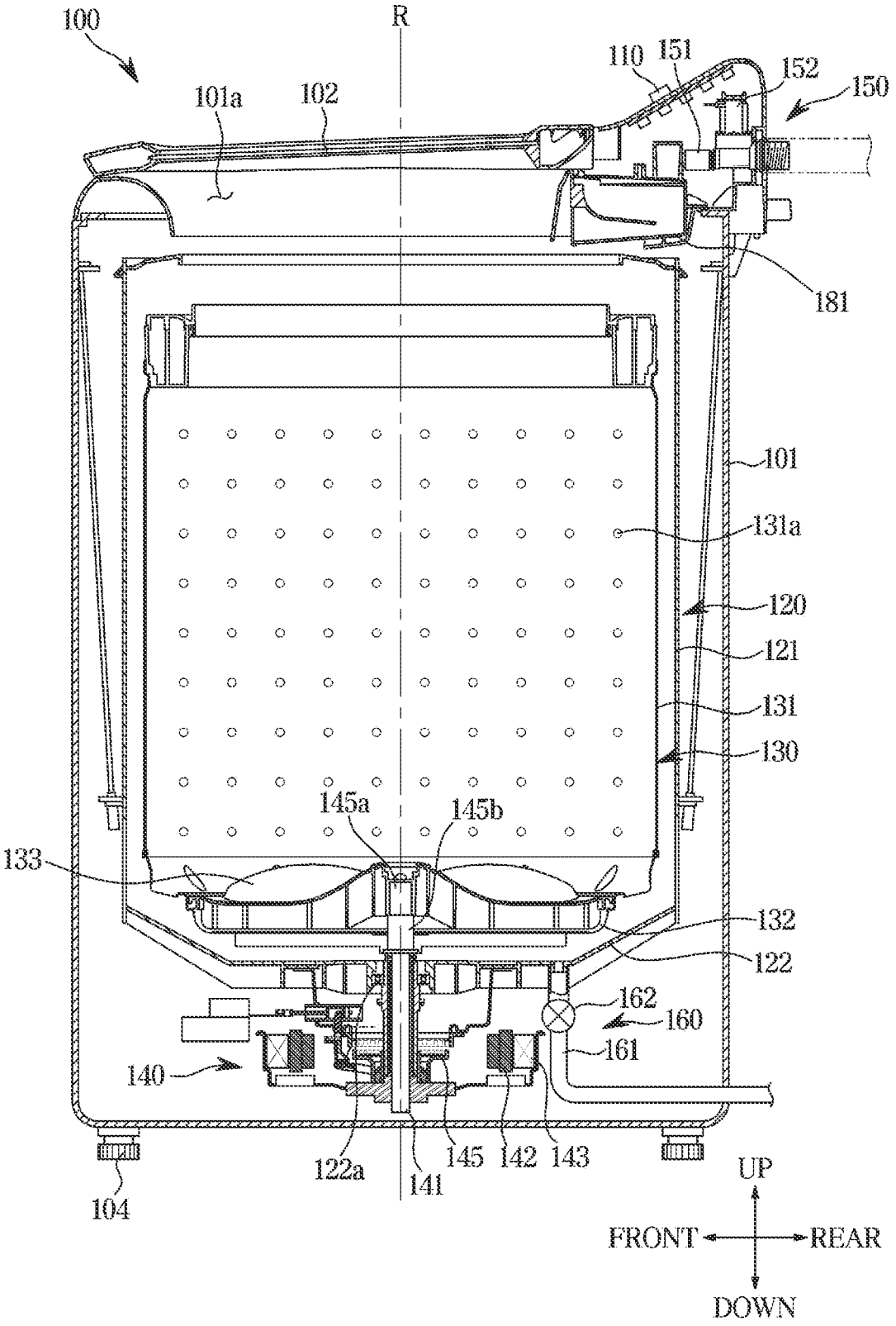
FIG. 2 illustrates a side cross-sectional view of a configuration of a washing machine according to an embodiment.

FIG. 1 illustrates a side cross-sectional view of the configuration of a washing machine according to an embodiment. FIG. 2 illustrates a side cross-sectional view of the configuration of a washing machine according to an embodiment.

A washing machine 100 according to an embodiment may include a front-loading washing machine in which an inlet 101*a* for inserting or withdrawing laundry is provided on a front surface of the washing machine 100, as shown in FIG. 1, and a top-loading washing machine in which an inlet 101*a* is provided on an upper surface of the washing machine 100, as shown in FIG. 2. That is, the washing machine 100 according to an embodiment may be a front-loading washing machine or a top-loading washing machine.

Referring to FIGS. 1 and 2 together, a door 102 for opening and closing the inlet 101*a* is provided on one surface of a cabinet 101. The door 102 may be provided on the same surface as the inlet 101*a* and may be rotatably mounted to the cabinet 101 by a hinge.

A tub 120 may be provided inside the cabinet 101. The tub 120 may accommodate water for washing or rinsing laundry.

The cabinet 101 may form the external appearance of the washing machine 100 and accommodate components, such as the tub 120 and the drum 130, and may be referred to as a frame or a body. That is, regardless of the terms used, any part that performs the same role as the cabinet 101 according to the present embodiment may be considered a part corresponding to the cabinet 101 of the washing machine 100.

The tub 120 may include a tub bottom 122 having a substantially circular shape and a tub sidewall 121 provided along the circumference of the tub bottom 122. A surface facing the tub bottom 122 of the tub 120 has an opening that allows laundry to be inserted or withdrawn.

In the case of a front-loading washing machine, the tub 120 may be disposed such that the tub bottom 122 faces the rear side of the washing machine and the central axis R of the tub sidewall 121 is substantially parallel to the floor, as shown in FIG. 1.

In the case of a top-loading washing machine, the tub 120 may be disposed such that the tub bottom 122 faces the bottom of the washing machine and the central axis R of the tub sidewall 121 is substantially perpendicular to the floor, as shown in FIG. 2.

The drum 130 may be rotatably provided inside the tub 120. The drum 130 may receive power for rotation from a motor 140. A bearing 122*a* for rotatably fixing the motor 140 may be provided on the tub bottom 122.

The drum 130 may accommodate laundry. For example, the drum 130 may have a cylindrical shape with one bottom that is open. The drum 130 may include a drum bottom 132 having a substantially circular shape and a drum sidewall 131 provided along the circumference of the drum bottom 132. The other bottom of the drum 130 may have an opening such that laundry may be inserted into or withdrawn from the drum 130.

The drum sidewall 131 may be provided with through holes 131*a* connecting the inside and outside of the drum 130 such that water supplied to the tub 120 flows into the drum 130.

In the case of a front-loading washing machine, the drum sidewall 131 may be provided with a lifter 131*b* to lift laundry to the upper side of the drum 130 while the drum 130 is rotating, as shown in FIG. 1.

In the case of a top-loading washing machine, a pulsator 133 may be rotatably provided on the inside of the drum bottom 132, as shown in FIG. 2. The pulsator 133 may rotate independently of the drum 130. In other words, the pulsator 133 may rotate in a different direction from that of the drum 130 as well as in the same direction as the drum 130. The pulsator 133 may rotate at the same rotational speed as that of the drum 130 or at a different rotational speed from that of the drum 130.

The drum bottom 132 may be connected to a rotating shaft 141 of the motor 140 that rotates the drum 130. The motor 140 may generate torque for rotating the drum 130.

The motor 140 may be provided outside of the tub bottom 122 of the tub 120, and may be connected to the drum bottom 132 of the drum 130 through the rotating shaft 141. The rotating shaft 141 may penetrate through the tub bottom 122 while being rotatably supported by the bearing 122*a* provided on the tub bottom 122.

The motor 140 may include a stator 142 fixed to the outside of the tub bottom 122 and a rotor 143 rotatably provided with respect to the tub 120 and the stator 142. The rotor 143 may be connected to the rotating shaft 141.

The rotor 143 may rotate through magnetic interaction with the stator 142, and rotation of the rotor 143 may be transmitted to the drum 130 through the rotating shaft 141.

The motor 140 may include, for example, a brushless direct current (BLDC) motor or a permanent magnet synchronous motor (PMSM), of which the rotational speed is easily controlled.

In the case of a top-loading washing machine, as shown in FIG. 2, a clutch 145 for transmitting torque of the motor 140 to both the pulsator 133 and the drum 130 or to the pulsator 133 may be provided. The clutch 145 may be connected to the rotating shaft 141. The clutch 145 may distribute rotation of the rotating shaft 141 to an inner shaft 145*a* and an outer shaft 145*b*.

The inner shaft 145*a* may be connected to the pulsator 133. The outer shaft 145*a* may be connected to the drum bottom 132. The clutch 145 may transmit the rotation of the rotating shaft 141 to both the pulsator 133 and the drum 130 through the inner shaft 145*a* and the outer shaft 145*b*, or transmit the rotation of the rotating shaft 141 to the pulsator 133 (e.g., only to the pulsator 133 in certain embodiments) through the inner shaft 145*a*.

A water supply device 150 may supply water to the tub 120 and the drum 130. The water supply device 150 may include a first water supply device 151 for supplying detergent-free water to the drum 130 and a second water supply device 152 for supplying detergent-containing water to the tub 120 and the drum 130.

The water supply device 150 includes water supply conduits 151*b* and 152*b* connected to an external water supply source to supply water to the tub 120 and water supply valves 151*a* and 152*a* provided on the water supply conduits 151*b* and 152*b*.

The water supply conduits 151*b* and 152*b* may be provided at the upper side of the tub 120 and may extend from the external water supply source to a detergent box 181 or the front of the tub 120.

The water supply valves 151*a* and 152*a* may allow or block the supply of water from the external water supply source to the tub 120 in response to an electrical signal. For example, the water supply valves 151*a* and 152*a* may include solenoid valves that open and close in response to electrical signals.

A detergent supply device 180 may supply detergent to the tub 120 and the drum 130. The detergent supply device 180 includes a detergent box 181 provided on the upper side of the tub 120 to store detergent and a mixing conduit 182 connecting the detergent box 181 to the tub 120.

The detergent box 181 may be connected to the second water supply conduit 152*b*, and water supplied through the second water supply conduit 152*b* may be mixed with detergent in the detergent box 181. A mixture of detergent and water may be supplied to the tub 120 through the mixing conduit 182.

The first water supply conduit 151*b* may be connected to the external water supply source and supply water to the tub 120 without passing through the detergent box 181. Detergent-free water may be used as rinsing water. To this end, the first water supply conduit 151*b* may be connected to at least one nozzle 151*c* and 151*d* for supplying detergent-free water into the tub 120.

The at least one nozzle 151*c* and 151*d* includes a first nozzle 151*c* that sprays detergent-free water toward the door 102 and a second nozzle 151*d* that sprays detergent-free water toward the tub 120.

The first nozzle 151*c* may spray water in a downward vertical direction toward the door 102, and the water in the downward vertical direction may wash the door 102 and then gather in the tub 120.

The second nozzle 151*d* may spray water into the drum 130, and may be inclined toward the inside of the drum 130 to have a spraying angle that does not interfere with the door 102. Accordingly, detergent-free water sprayed through the second nozzle 151*d* may be directly stored in the tub 120.

A drainage device 160 may discharge water contained in the tub 120 or the drum 130 to the outside. The drainage device 160 may include a drain conduit 161 provided on a lower side of the tub 120 and extending from the tub 120 to the outside of the cabinet 101.

In the case of a front-loading washing machine, as shown in FIG. 1, the drainage device 160 may further include a drain pump 163 provided in the drain conduit 161.

In the case of a top-loading washing machine, as shown in FIG. 2, the drainage device 160 may further include a drain valve 162 provided on the drain conduit 161.

Referring to FIGS. 1 and 2, a plurality of legs 104 for supporting the washing machine 100 may be provided on the lower portion of the cabinet 101. For example, each of the plurality of legs 104 may have an adjustable height, and the height of each of the plurality of legs 104 may be adjusted according to the slope of the ground on which the washing machine 100 is disposed.

The structure described with reference to FIGS. 1 and 2 is only an example applicable to the washing machine 100 according to an embodiment, and the washing machine 100 according to an embodiment may have a structure partially different from the above-described structure.

Figure 3:
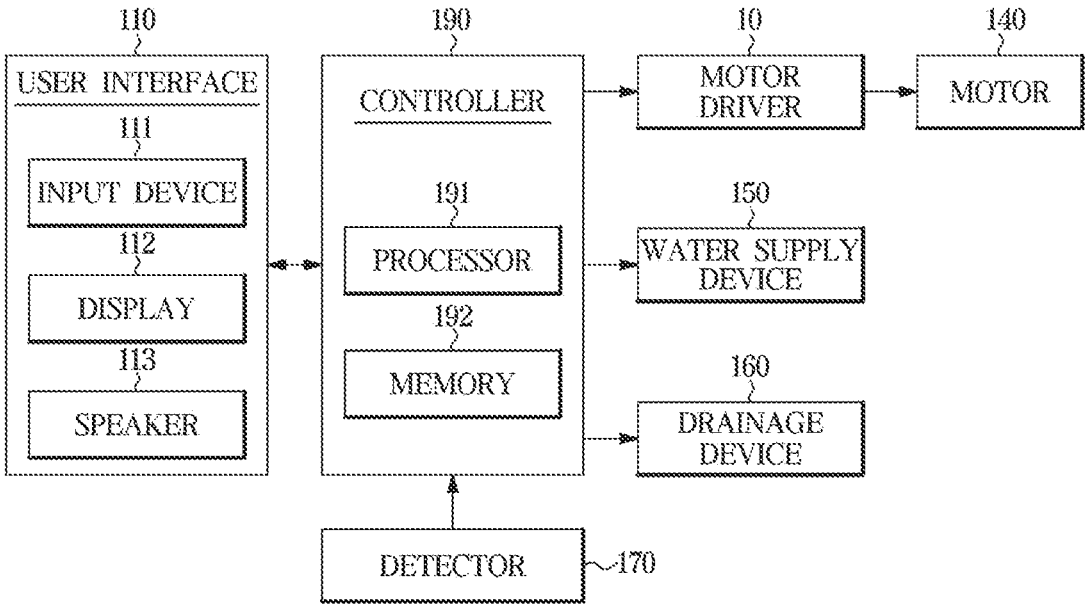
FIG. 3 illustrates a block diagram of an operation of a washing machine according to an embodiment.
Figure 4:
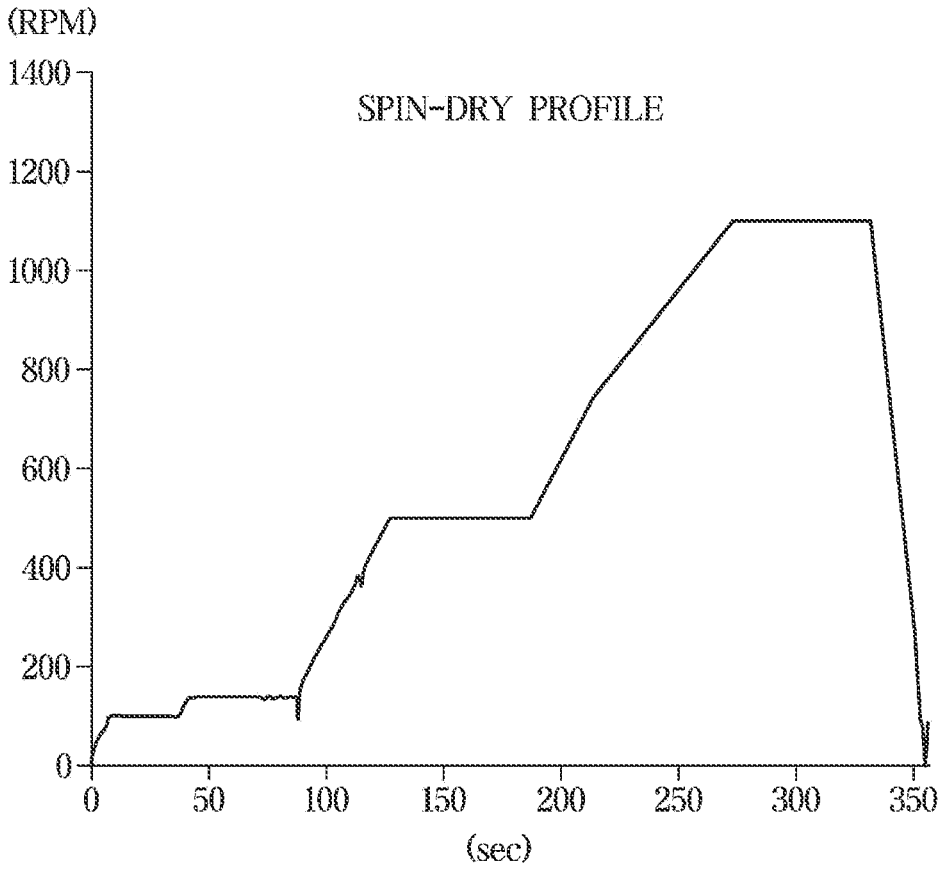
FIG. 4 illustrates a graph of an example of a spin-drying profile applied to a spin-drying process of a washing machine according to an embodiment.

FIG. 3 illustrates a block diagram of an operation of a washing machine according to an embodiment. FIG. 4 illustrates a graph of an example of a spin-drying profile applied to a spin-drying process of a washing machine according to an embodiment.

Referring to FIG. 3, the washing machine 100 according to an embodiment may further include a motor driver 10 that supplies driving current to the motor 140, a user interface 110, and a controller 190 that controls overall operations of the washing machine 100, in addition to the water supply device 150, the drainage device 160, and the motor 140 for rotating the drum 130.

For example, the motor driver 10 may include a rectifier circuit, a direct current (DC) link circuit, and an inverter circuit. The rectifier circuit may include a diode bridge composed of a plurality of diodes, and may rectify AC power of an external power source. The DC link circuit may include a DC link capacitor that stores electrical energy, and may remove ripples of rectified power and output DC power.

The inverter circuit may include a plurality of switching element pairs, convert DC power of the DC link circuit into DC or AC driving power, and supply the driving current to the motor 140.

The user interface 110 may include an input device 111 that receives a user input for selecting power on/off of the washing machine 100, selecting start/stop of the operation of the washing machine 100, selecting a washing course, selecting a rinsing process or spin-drying process, or selecting a process execution time or strength of the washing machine 100.

In addition, the user interface 110 may include a display 112 for displaying various types of information for guiding the above-described user input, displaying information on a currently ongoing process, or displaying information on a state of the washing machine 100.

In addition, the user interface 110 may further include a speaker 113 that audibly outputs a notification regarding an operation or state of the washing machine 100.

The input device 111 and the display 112 may be provided separately, or may implement a touch screen in cooperation with each other.

The washing machine 100 may include a detector 170 that detects data indicating the current state of the washing machine 100. For example, the detector 170 may include a current sensor that detects a current flowing through the motor 140. In addition, the washing machine 100 may include a vibration sensor that detects vibration generated in the washing machine 100, and details thereof will be described below.

The controller 190 may control the operation of the washing machine 100 according to the user input received by the user interface 110, and when controlling the operation of the washing machine 100, use the output of the detector 170.

The controller 190 includes at least one memory 192 storing a program for performing the above-described operation and an operation to be described below, and at least one processor 191 executing the stored program.

For example, the controller 190 may, in order to perform washing according to a washing course selected by the user, control the water supply device 150 to supply water to the drum 130 and control the motor driver 10 to rotate the drum 130, to perform a washing process, a rinsing process, and a spin-drying process. Alternatively, according to a user's selection, the washing process may be omitted and at least one of the rinsing process or the spin-drying process may be performed.

The controller 190 may, when performing a spin-drying process, rotate the drum 130 according to a predetermined spin-drying profile. Here, the rotating, by the controller 190, of the drum 130 may include controlling the motor 140, and the controlling of the motor 140 may include transmitting a control signal to the motor driver 10.

For example, the controller 190 may rotate the drum 130 according to a spin-drying profile shown in FIG. 4. The spin-drying profile may be defined by the rotational speed (revolutions per minute, rpm) of the drum 130.

Referring to FIG. 4, the controller 190 may, for the spin-drying process, gradually increase the rotational speed of the drum 130. The rotational speed may be increased to about 100 rpm and kept for a certain time, and then increased to about 150 rpm and kept for a certain time, and then increased to about 500 rpm and kept for a certain time, and then increased to about 1100 rpm and kept for a certain time, and finally the drum 130 may be stopped. In this example, each of these rotational speeds (e.g., 100, 150, 500, 1100 rpm) respectively represent a maximum rotation speed of the drum according to the spin-dry profile.

The spin-drying profile may be stored in the memory 192, and the processor 191 may rotate the drum 130 according to the stored spin-drying profile to perform a spin-drying process. Alternatively, it is also possible to appropriately change the spin-drying profile according to the load of laundry accommodated in the drum 130.

The spin-drying profile of FIG. 4 is only an example applicable to the embodiment of the washing machine 1, and a spin-drying profile different from that of FIG. 4 may also be adopted.

As shown in the spin-drying profile of FIG. 4, the drum 130 rotates at a high speed during the spin-drying process. In this case, large vibrations may occur due to eccentricity of laundry, and such vibrations may cause the washing machine 100 to be moved, or parts of the washing machine 100 to be brought to friction. In addition, noise due to vibration may cause inconvenience in using the washing machine 100.

Accordingly, the washing machine 100 according to an embodiment performs a process for detecting vibration generated during the spin-drying process and reducing the vibration. In addition, an appropriate process according to the cause of the vibration may be performed so that the vibration may be effectively reduced. Hereinafter, related operations will be described in detail.

Figure 5:
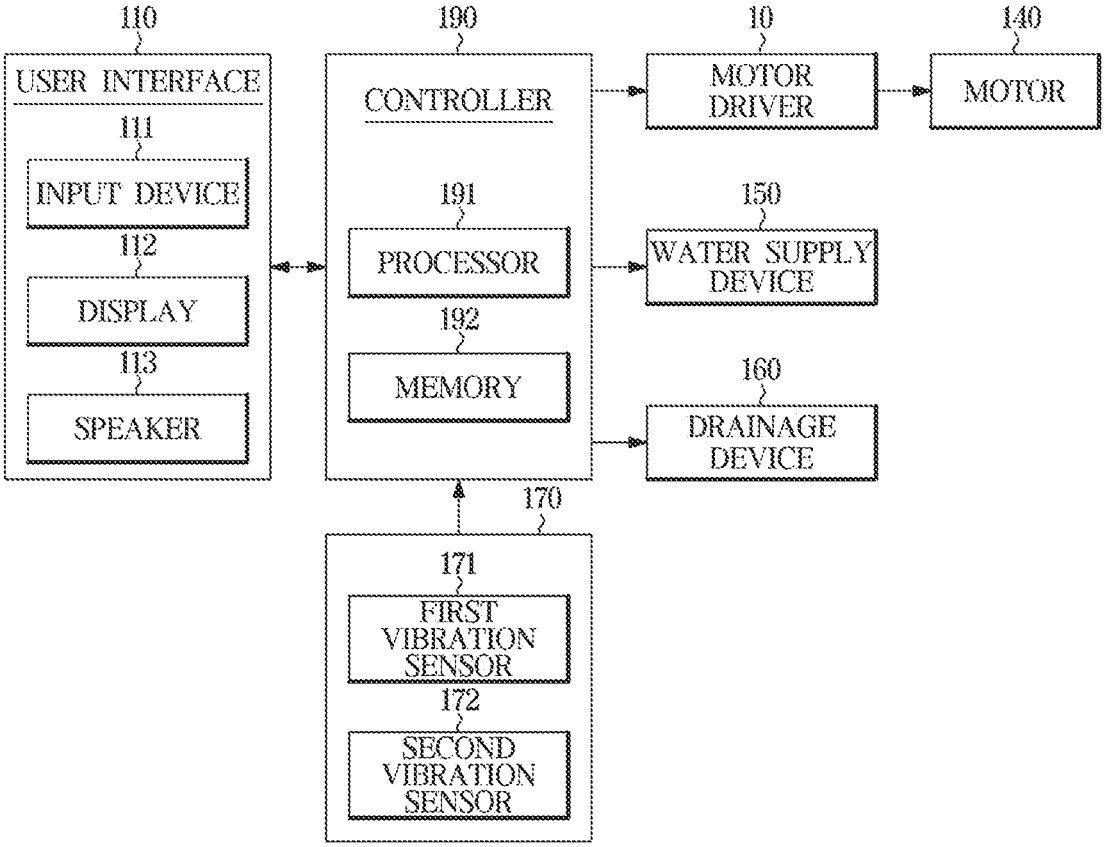
FIG. 5 illustrates another block diagram of an operation of a washing machine according to an embodiment.
Figure 6:
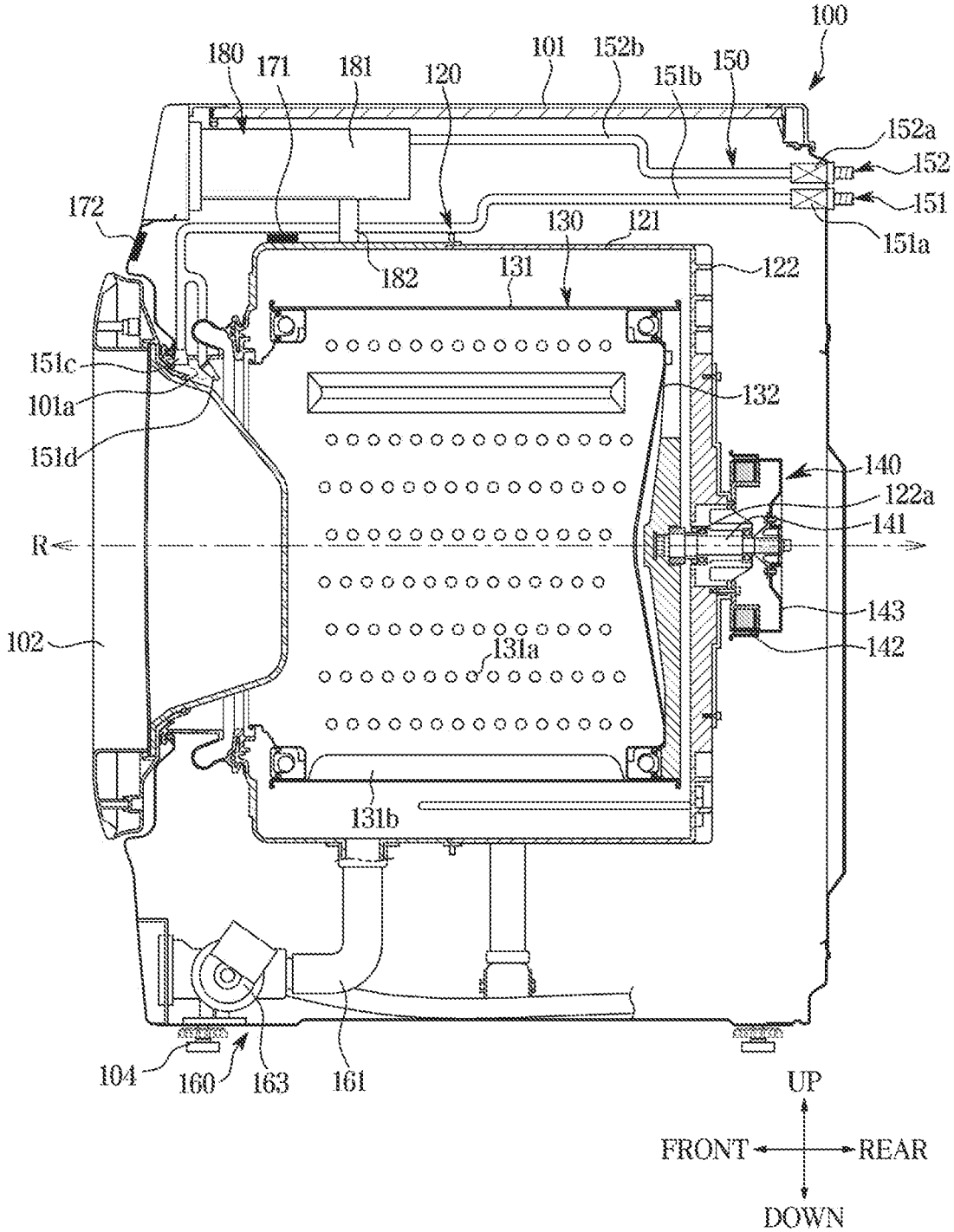
FIG. 6 illustrates a side cross-sectional view of a washing machine including a vibration sensor according to an embodiment.

FIG. 5 illustrates another block diagram of an operation of a washing machine according to an embodiment. FIG. 6 illustrates a side cross-sectional view of a washing machine including a vibration sensor according to an embodiment.

Referring to FIG. 5, the detector 170 of the washing machine 100 according to an embodiment may include a first vibration sensor 171 for detecting vibration of the tub 120 and a second vibration sensor 172 for detecting vibration of the cabinet 101.

For example, as shown in FIG. 6, the first vibration sensor 171 may be provided on the front portion of the upper surface of the tub 120, and the second vibration sensor 172 may be provided on the upper side of the front inner surface of the cabinet 101. When the first vibration sensor 171 and the second vibration sensor 172 are mounted at such positions, vibration generated from the tub 120 and vibration generated from the cabinet 101 may be effectively detected, respectively.

However, the positions of the first vibration sensor 171 and the second vibration sensor 172 shown in FIG. 6 are only examples applicable to the embodiment of the washing machine 100. In addition to the positions shown in FIG. 6, the first vibration sensor 171 and the second vibration sensor 172 may be mounted at other positions at which the vibration of the tub 120 and the vibration of the cabinet 101 may be effectively detected.

The first vibration sensor 171 and the second vibration sensor 172 may be implemented as at least one of various sensors for detecting vibration. For example, the first vibration sensor 171 and the second vibration sensor 172 may be implemented as at least one of a displacement sensor that measures vibration displacement, a speed sensor that measures speed, or an acceleration sensor that measures acceleration.

Specifically, the first vibration sensor 171 and the second vibration sensor 172 may be implemented as microelectromechanical systems (MEMS) to improve vibration detecting performance. In this case, the MEMS may be an MEMS provided on a printed circuit board (PCB) of the washing machine 100. For example, the PCB on which the MEMS is provided may be a PCB connected to the user interface 110 or a PCB on which the controller 190 is to be provided.

In addition, the first vibration sensor 171 and the second vibration sensor 172 may be provided in at least one unit thereof. That is, the first vibration sensor 171 and the second vibration sensor 172 may each be provided in one unit thereof, or at least one of the first vibration sensor 171 or the second vibration sensor 172 may be provided in two or more units thereof.

That is, the first vibration sensor 171 and the second vibration sensor 172 are configured to effectively measure the vibration generated from the tub 120 and the cabinet 101, and there is no other restriction on the number or location of the first vibration sensor 171 and the second vibration sensor 172.

FIG. 7 is a table showing an example of a vibration detecting section in which a washing machine detects vibration during a spin-drying process according to an embodiment.

As described above, the controller 190 may perform a spin-drying process according to a spin-drying profile. That is, in order to perform the spin-drying process, the controller 190 may rotate the drum 130 according to the spin-drying profile. The spin-drying profile may be stored in advance, or may be a spin-drying profile changed based on factors, such as the load of laundry.

The controller 190 may control the rotation of the drum 130 based on the output of the first vibration sensor 171 and the output of the second vibration sensor 172 during the spin-drying process. That is, the controller 190 may control the motor 140 rotating the drum 130.

The controlling, by the controller 190, of the rotation of the drum 130 based on the output of the first vibration sensor 171 and the output of the second vibration sensor 172 during the spin-drying process may be a vibration reduction control for reducing the vibration generated in the tub 120 or the cabinet 101.

The spin-drying profile may be divided into a plurality of sections according to the rotational speed of the rotating drum 130 during the spin-drying process. The controller 190 may detect vibration in at least some sections among the plurality of sections included in the spin-drying profile, and perform vibration reduction control in response to occurrence of vibration exceeding a reference value.

For example, as shown in FIG. 7, the vibration detecting section may include a first section in which the drum 130 rotates at a speed of 500 rpm, a second section in which the drum 130 rotates at a speed of 800 rpm, a third section in which the drum 130 rotates at a speed of 950 rpm, and a fourth section in which the drum 130 rotates at a speed of 1100 rpm.

The vibration detecting section in the example is when the above-described spin-drying profile of FIG. 4 is adopted. However, even when the spin-drying profile of FIG. 4 is adopted, the vibration detecting section may be set in an rpm range different from that of the vibration detecting section of FIG. 7.

Upon start of a spin-drying process, the controller 190 may identify vibration values based on outputs of the first vibration sensor 171 and the second vibration sensor 172 in the first, second, third, and fourth sections.

The controller 190 may, based on the identified vibration value exceeding a predetermined reference value, identify that vibration exceeding a permissible value has occurred and perform vibration reduction control. Here, the vibration value may include a first vibration value corresponding to the output of the first vibration sensor 171 and a second vibration value corresponding to the output of the second vibration sensor 172.

The first vibration value may be a value calculated based on the output of the first vibration sensor 171. For example, when the first vibration sensor 171 is implemented as an MEMS, the output of the first vibration sensor 171 may include acceleration values on three axes. The controller 190 may calculate a displacement due to vibration based on the acceleration values of three axes output from the first vibration sensor 171. The calculated displacement may provide the first vibration value.

The second vibration value may be a value calculated based on the output of the second vibration sensor 172. For example, when the second vibration sensor 172 is implemented as an MEMS, the output of the second vibration sensor 172 may include acceleration values on three axes. The controller 190 may calculate a displacement due to vibration based on acceleration values of three axes output from the second vibration sensor 172. The calculated displacement may provide the second vibration value.

Alternatively, raw data output from the first vibration sensor 171 may be used as the first vibration value, and raw data output from the second vibration sensor 172 may be used as the second vibration value.

Meanwhile, in addition to those of the above example, values obtained based on the first vibration sensor 171 and the second vibration sensor 172 and representing the amount of vibration generated in the tub 120 and the amount of vibration generated in the cabinet 101 may be used as the first vibration value and the second vibration value.

Figure 8:
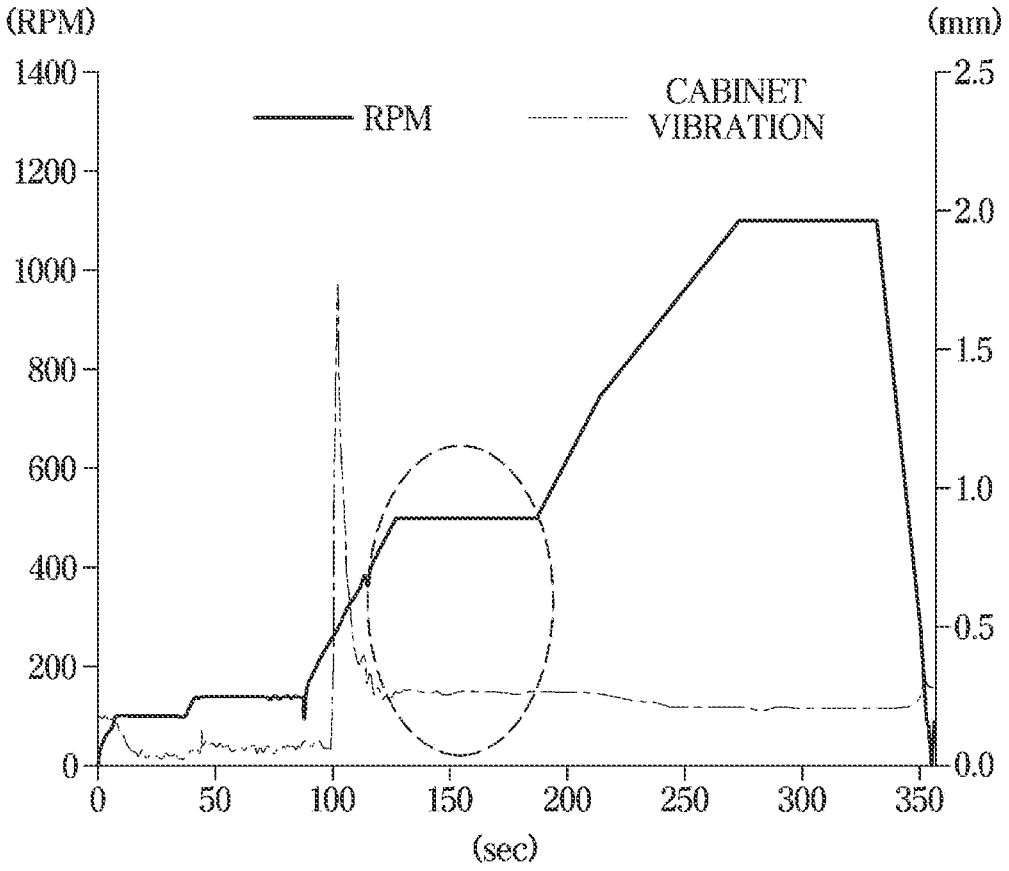
FIG. 8 illustrates a graph of cabinet vibration when a washing machine is disposed on a hard floor and a plurality of legs are in a balanced state according to an embodiment.
Figure 9:
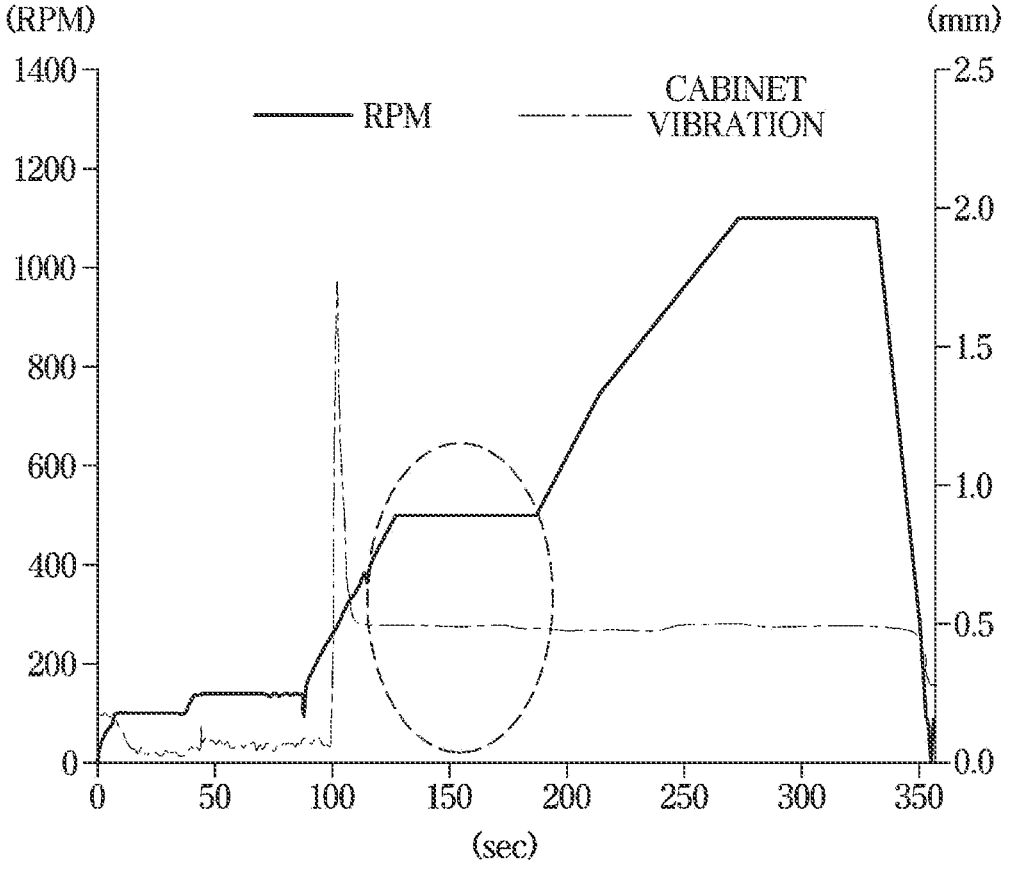
FIG. 9 illustrates a graph of cabinet vibration when a washing machine according to an embodiment is disposed on a hard floor and a plurality of legs are in an unbalanced state.
Figure 10:
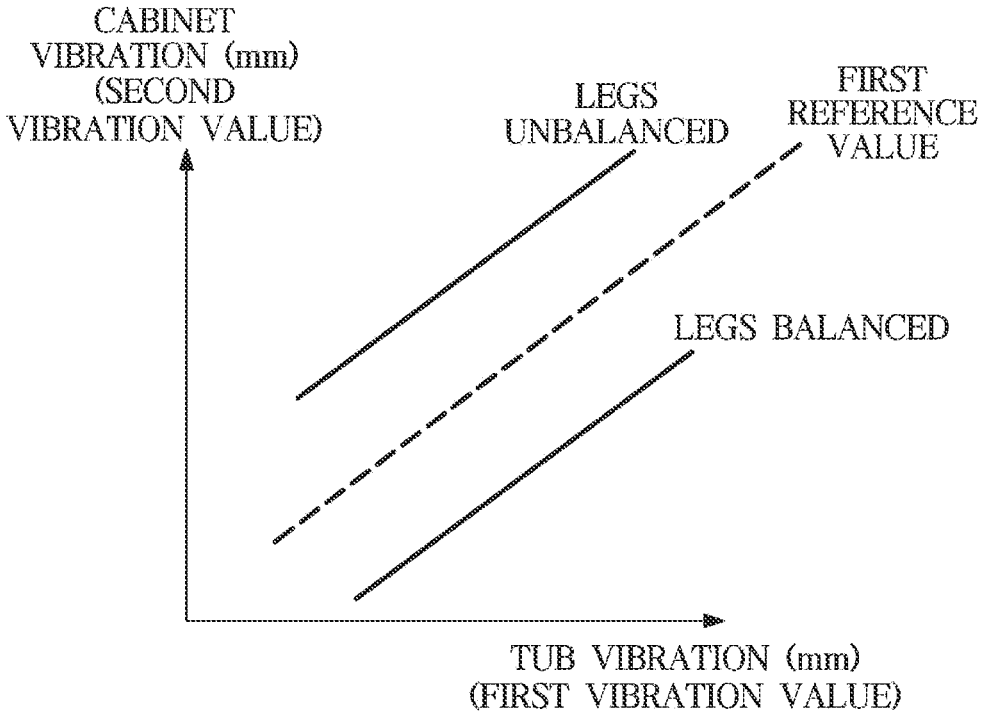
FIG. 10 illustrates a graph of a criterion for determining whether a plurality of legs of a washing machine are in an unbalanced state according to an embodiment.

FIG. 8 illustrates a graph of cabinet vibration when a washing machine is disposed on a hard floor and a plurality of legs are in a balanced state according to an embodiment. FIG. 9 illustrates a graph of cabinet vibration when a washing machine according to an embodiment is disposed on a hard floor and a plurality of legs are in an unbalanced state. FIG. 10 illustrates a graph of a criterion for determining whether a plurality of legs of a washing machine are in an unbalanced state according to an embodiment.

As described above, a plurality of legs 104 for supporting the washing machine 100 may be provided on the lower portion of the washing machine 100. Vibration characteristics of the washing machine 100 may appear different between when the plurality of legs 104 are installed in a balanced state and when the plurality of legs 104 are installed in an unbalanced state.

The graphs of FIGS. 8 and 9 are graphs showing changes in the rotational speed of the drum 130 and corresponding changes in the second vibration value during the spin-drying process, under the condition of an eccentric load of 600*g*.

In addition, the graph in FIG. 8 is a graph measured for the washing machine 100 in which the plurality of legs 104 are installed in a balanced state on a hard floor, and the graph in FIG. 9 is a graph measured for the washing machine 100 in which the plurality of legs 104 are installed in an unbalanced state on a hard floor.

Referring to FIGS. 8 and 9, the range of 200 to 300 rpms corresponds to a resonance section, in which the second vibration value rapidly increases, and after 300 rpm, the second vibration value is maintained constant. However, when the plurality of legs 104 are installed in an unbalanced state, it can be seen that the second vibration value (in FIG. 9) is maintained higher than the second vibration value (in FIG. 8) when the plurality of legs 104 are installed in a balanced state.

Meanwhile, even in a state in which the plurality of legs 104 are balanced, the cabinet 101 may vibrate greatly in proportion to great vibration of the tub 120. Therefore, when a great cabinet vibration occurs at the same tub vibration the controller 190 determines that the plurality of legs 104 are installed in an unbalanced state.

The washing machine 100 according to an embodiment considers both the vibration generated in the tub 120 and the vibration generated in the cabinet 101 using both the first vibration sensor 171 and the second vibration sensor 172, thereby more accurately identifying the cause of occurrence of vibration and taking more appropriate measures considering the cause of occurrence of vibration.

The controller 190 may store information about a first reference value for determining an unbalanced state of the plurality of legs 104. As shown in FIG. 10, first reference values according to first vibration values indicating tub vibration may be stored.

In the example of FIG. 10, the positive correlation between tub vibration and cabinet vibration is illustrated as exhibiting a linear relationship, but the embodiment of the washing machine 100 is not limited thereto. The tub vibration and the cabinet vibration may not have a linear relationship, and even in this case, first reference values corresponding to the tub vibration may also be stored.

The controller 190 may, based on the second vibration value representing cabinet vibration being exceeding the first reference value corresponding to the first vibration value, identify that the plurality of legs 104 are in an unbalanced state and perform vibration reduction control corresponding thereto.

For example, the controller 190 may maintain the current rotational speed of the drum 130 or lower the maximum rotational speed of the drum 130. Specific operations will be described together with an embodiment of a method of controlling a washing machine.

The controller 190 may, in order to determine whether the plurality of legs 104 are in an balanced state, compare the second vibration value with the first reference value corresponding to the first vibration value in the first section in which the drum 130 rotates at a speed of 500 rpm.

Whether the second vibration value exceeds the first reference value in the first section may be referred to as a first condition, and based on the second vibration value exceeding the first reference value in the first section, the first condition is satisfied, and the controller 190 may perform first vibration reduction control for reducing vibration caused by leg imbalance.

Figure 11:
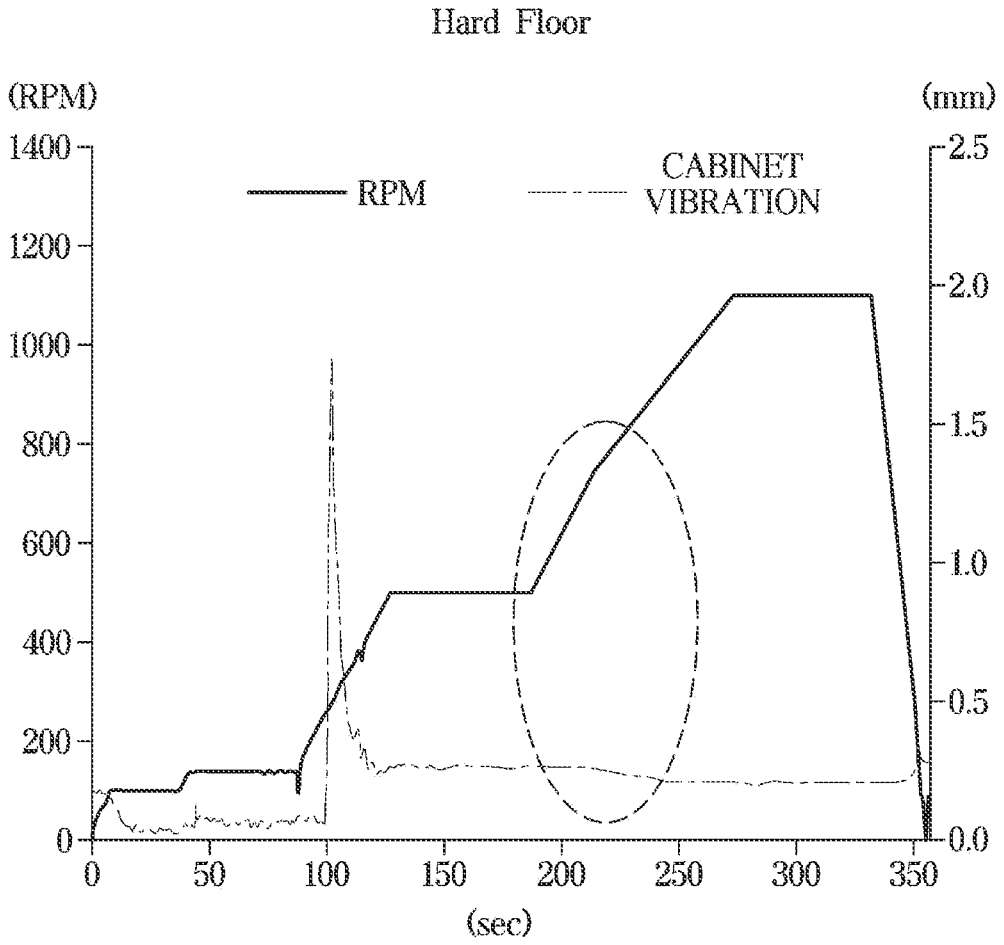
FIG. 11 illustrates a graph of cabinet vibration when a washing machine is disposed on a hard floor according to an embodiment.
Figure 12:
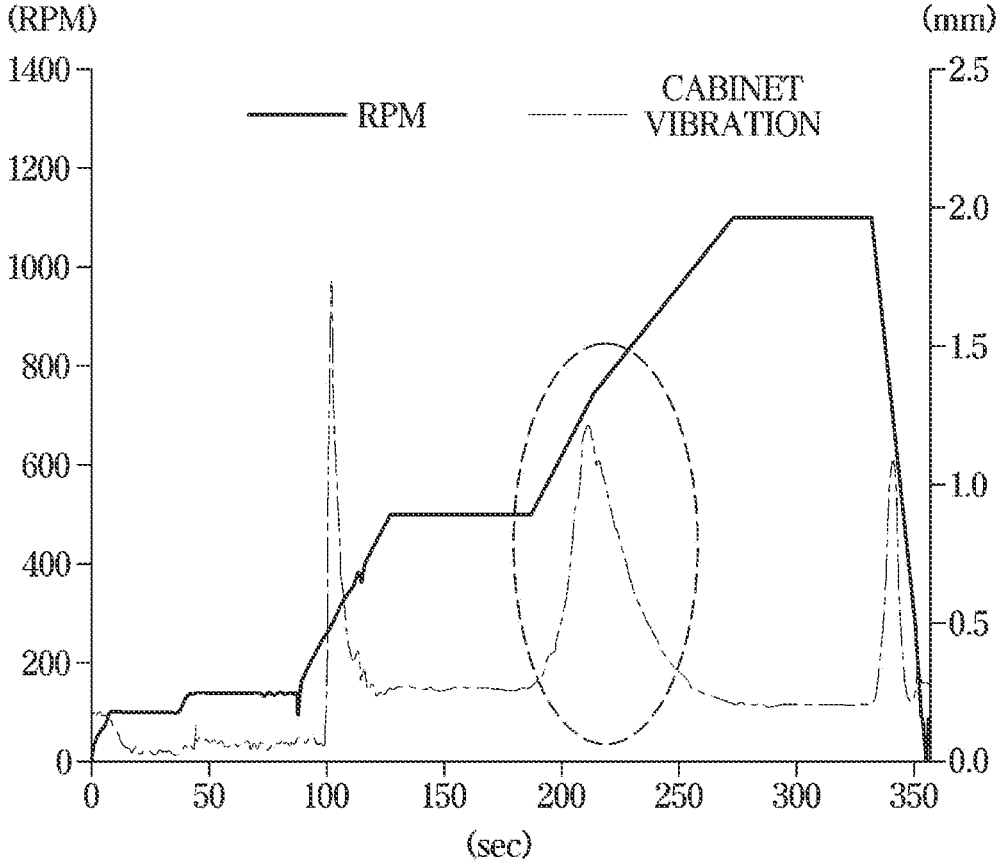
FIG. 12 illustrates a graph of cabinet vibration when a washing machine is disposed on a soft floor according to an embodiment.
Figure 13:
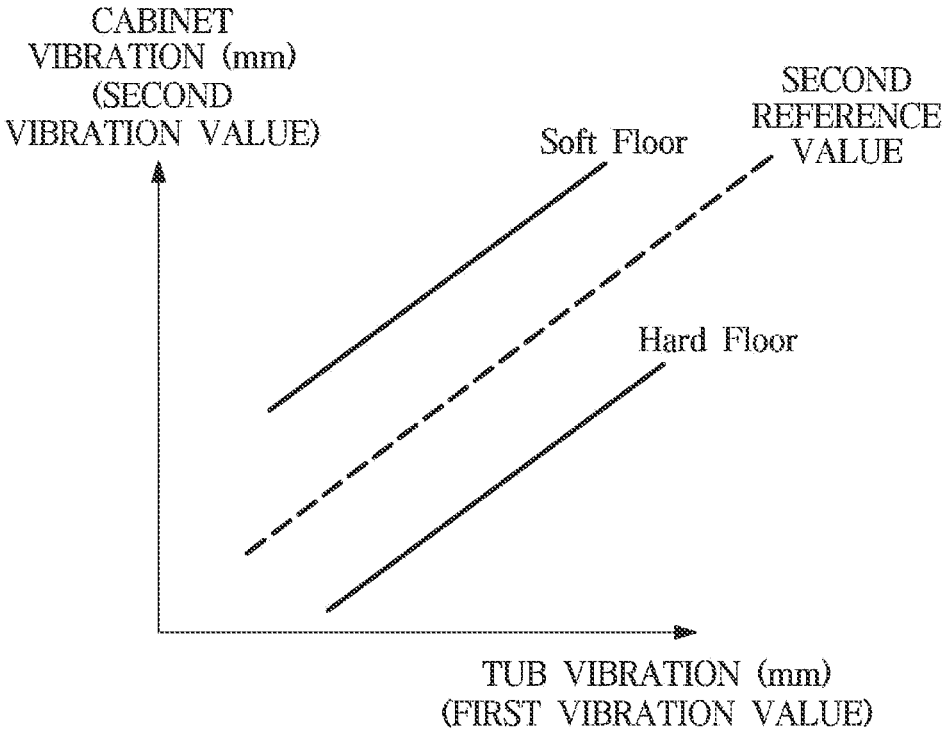
FIG. 13 illustrates a graph of a criterion for determining whether a washing machine is disposed on a soft floor according to an embodiment.

FIG. 11 illustrates a graph of cabinet vibration when a washing machine is disposed on a hard floor according to an embodiment. FIG. 12 illustrates a graph of cabinet vibration when a washing machine is disposed on a soft floor according to an embodiment. FIG. 13 illustrates a graph of a criterion for determining whether a washing machine is disposed on a soft floor according to an embodiment.

The graphs in FIGS. 11 and 12 are graphs showing changes in the rotational speed of the drum 130 and corresponding changes in the second vibration value during the spin-drying process, under the condition of an eccentric load of 600*g*.

The resonance frequency of the cabinet 101 may vary depending on the type of a floor on which the washing machine 100 is installed. A floor type with high hardness, such as concrete or tiles, may be referred to as a hard floor, and a floor type with low hardness, such as wood or carpet, may be referred to as a soft floor.

When the washing machine 100 is installed on the hard floor, a resonance point that occurs after 200-300 rpm is very high, so there is no resonance point appearing again on the spin-drying profile, shown in FIG. 11.

However, when the washing machine 100 is installed on the soft floor, as shown in FIG. 12, a resonance point exists in the range of 700 rpm to 900 rpm, so that even when tub vibration is small, cabinet vibration occurs greatly.

The controller 190 may store information about a second reference value for determining the type of a floor on which the washing machine 100 is installed. As shown in FIG. 13, second reference values according to the first vibration values indicating tub vibration may be stored.

In the example of FIG. 13, the positive correlation between tub vibration and cabinet vibration is illustrated as exhibiting a linear relationship, but the embodiment of the washing machine 100 is not limited thereto. The tub vibration and the cabinet vibration may not have a linear relationship, and even in this case, second reference values corresponding to the tub vibration may also be stored.

The controller 190 may, based on the second vibration value representing cabinet vibration being exceeding the second reference value corresponding to the first vibration value, identify that the washing machine 100 is installed on the soft floor and perform vibration reduction control corresponding thereto.

For example, the controller 190 may increase the rotational speed of the drum 130 to be higher than or equal to a threshold value in order to escape from the resonance point. Here, the threshold value may indicate a minimum value of a rotational speed (e.g., lower limit of rotational speed) that is greater than a resonance point appearing on the soft floor. More specific operations will be described together with an embodiment of a method of controlling a washing machine.

The controller 190 may, in order to identify whether the washing machine 100 is installed on the soft floor, compare a second vibration value with the second reference value in the second section in which the drum 130 rotates at a speed of 800 rpm.

Whether the second vibration value exceeds the second reference value in the second section may be referred to as a second condition, and based on the second vibration value being exceeding the second reference value in the second section, the second condition is satisfied, and the controller 190 may perform second vibration reduction control for reducing vibration caused by the soft floor.

Figure 14:
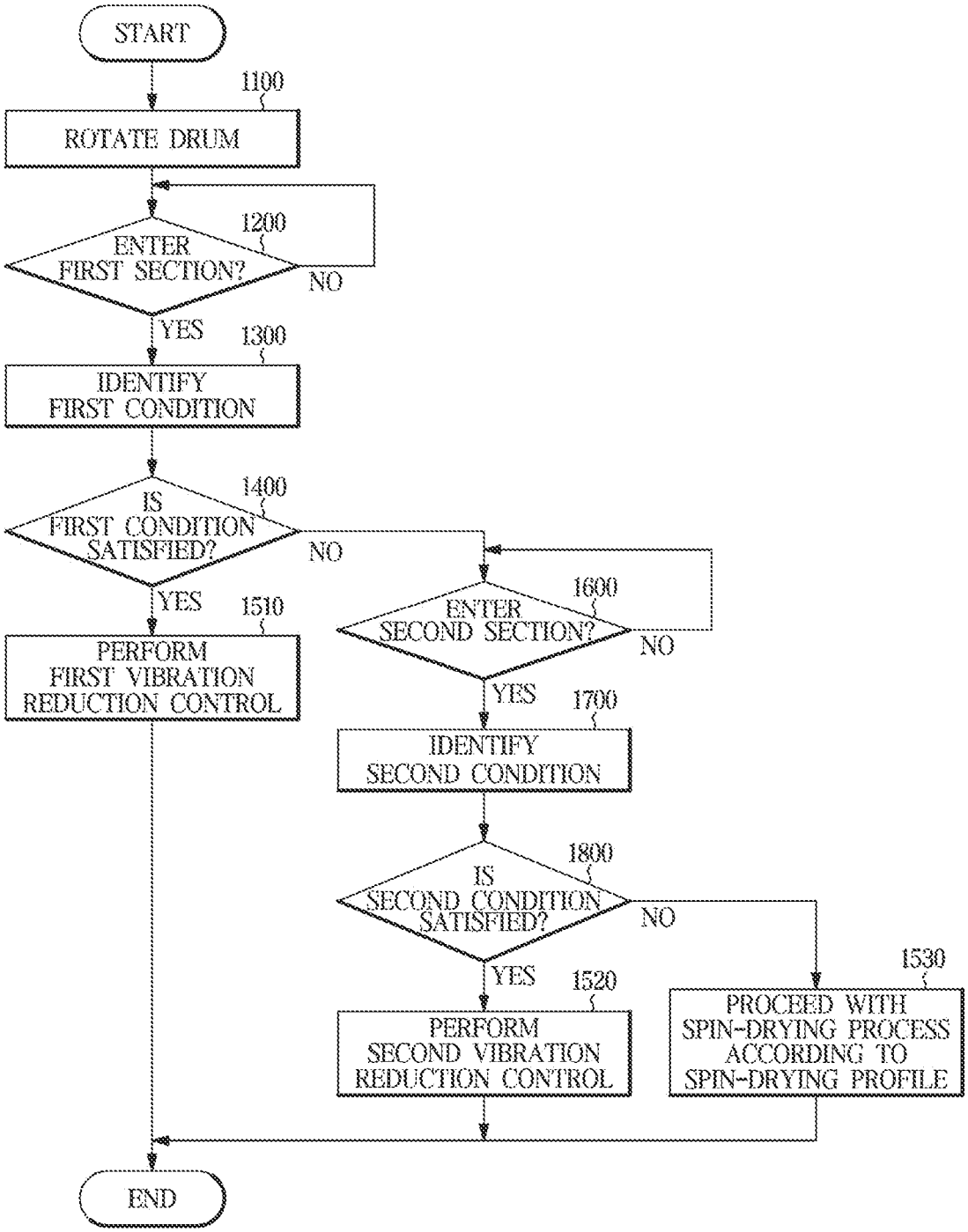
FIG. 14 illustrates a method of controlling a washing machine according to an embodiment.

FIG. 14 illustrates a method of controlling a washing machine according to an embodiment.

A method of controlling a washing machine according to an embodiment may be performed by the washing machine 100 according to the above-described embodiment. That is, in a method of controlling a washing machine according to an embodiment, a control target may be the washing machine 100 according to the above-described embodiment.

Accordingly, the above description of the washing machine 100 may also be applied to the method of controlling the washing machine according to the embodiment, unless stated otherwise. Conversely, contents about the method of controlling the washing machine according to the embodiment to be described below may also be applicable to the washing machine 100 unless stated otherwise.

The flow chart of FIG. 14 is a view showing operations between a start and an end of a spin-drying process.

Referring to FIG. 14, the controller 190 may, upon start of a spin-drying process, rotate the drum according to a spin-drying profile (in operation 1100).

Here, the rotating, by the controller 190, of the drum 130 may include controlling the motor 140, and the controlling of the motor 140 may include transmitting a control signal to the motor driver 10.

The controller 190 may perform the spin-drying process by rotating the drum 130 according to a pre-stored spin-drying profile. Alternatively, the controller 190 may appropriately change the spin-drying profile according to the load of laundry accommodated in the drum 130.

In the following example, the spin-drying process is performed according to the spin-drying profile shown in FIG. 4 described above, the vibration value is determined in the vibration detecting section of FIG. 7 described above, and vibration reduction control is performed according to the determined vibration value.

The controller 190 may, upon entering the first section (YES in operation 1200), identify the first condition (in operation 1300).

The first section may indicate a section in which the drum 130 rotates at a speed of 500 rpm. The controller 190 may, in order to identify the first condition, compare a second vibration value with a first reference value corresponding to a first vibration value. As described above, the first vibration value is a value corresponding to the output of the first vibration sensor 171, and the second vibration value is a value corresponding to the output of the second vibration sensor 172.

The controller 190 may, based on the second vibration value being exceeding the first reference value, identify that the first condition is satisfied.

The controller 190 may, based on the first condition being satisfied (YES in operation 1300), perform first vibration reduction control (in operation 1510).

As described above, based on the first condition being satisfied, the controller 190 may identify that the plurality of legs 104 of the washing machine 100 are in an unbalanced state, and appropriate vibration reduction control suitable for the state may be performed. Details thereof will be described below.

The controller 190 may, based on the first condition not being satisfied (NO in operation 1300), continue the spin-drying process according to the spin-drying profile, and upon entering the second section (YES in operation 1600), identify the second condition (in operation 1700).

The second section may indicate a section in which the drum 130 rotates at a speed of 800 rpm. The controller 190 may, in order to identify the second condition, compare the second vibration value with a second reference value corresponding to the first vibration value. The controller 190 may, based on the second vibration value being exceeding the second reference value, identify that the second condition is satisfied.

The controller 190 may, based on the second condition being satisfied (YES in operation 1800), perform second vibration reduction control (in operation 1520).

As described above, based on the second condition being satisfied, the controller 190 identifies that the washing machine 100 is disposed on the soft floor, and appropriate vibration reduction control suitable for the state may be performed. Details thereof will be described below.

Based on the second condition not being satisfied (NO in operation 1800), the controller 190 proceeds with the spin-drying process according to the spin-drying profile (in operation 1900).

The flow chart has been constructed in relation to vibration value identification and corresponding vibration reduction control in the first and second sections, but as shown in FIG. 7 described above, vibration value identification and corresponding vibration reduction control may also be performed in the third and fourth sections.

For example, based on the first vibration value corresponding to the output of the first vibration sensor 171 being exceeding a third reference value in the third section or the first vibration value being exceeding a fourth reference value in the fourth section, the motor 140 may be stopped and the spin-drying process may be restarted. Alternatively, the spin-drying process may be terminated after maintaining the current speed for a predetermined time in the corresponding section.

Figure 15:
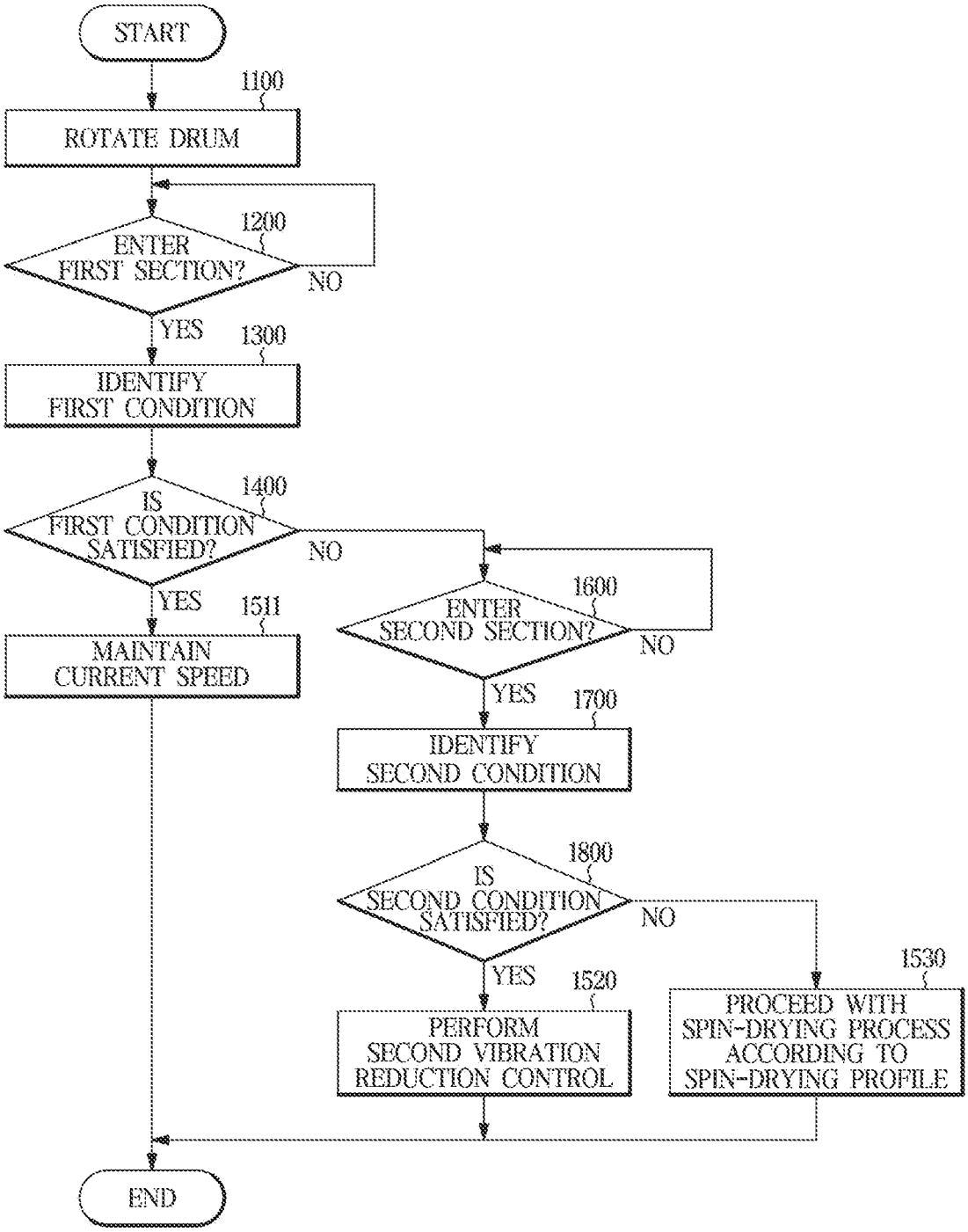
FIG. 15 illustrates a method that specifies a first vibration reduction control within the method of controlling a washing machine according to an embodiment.
Figure 16:
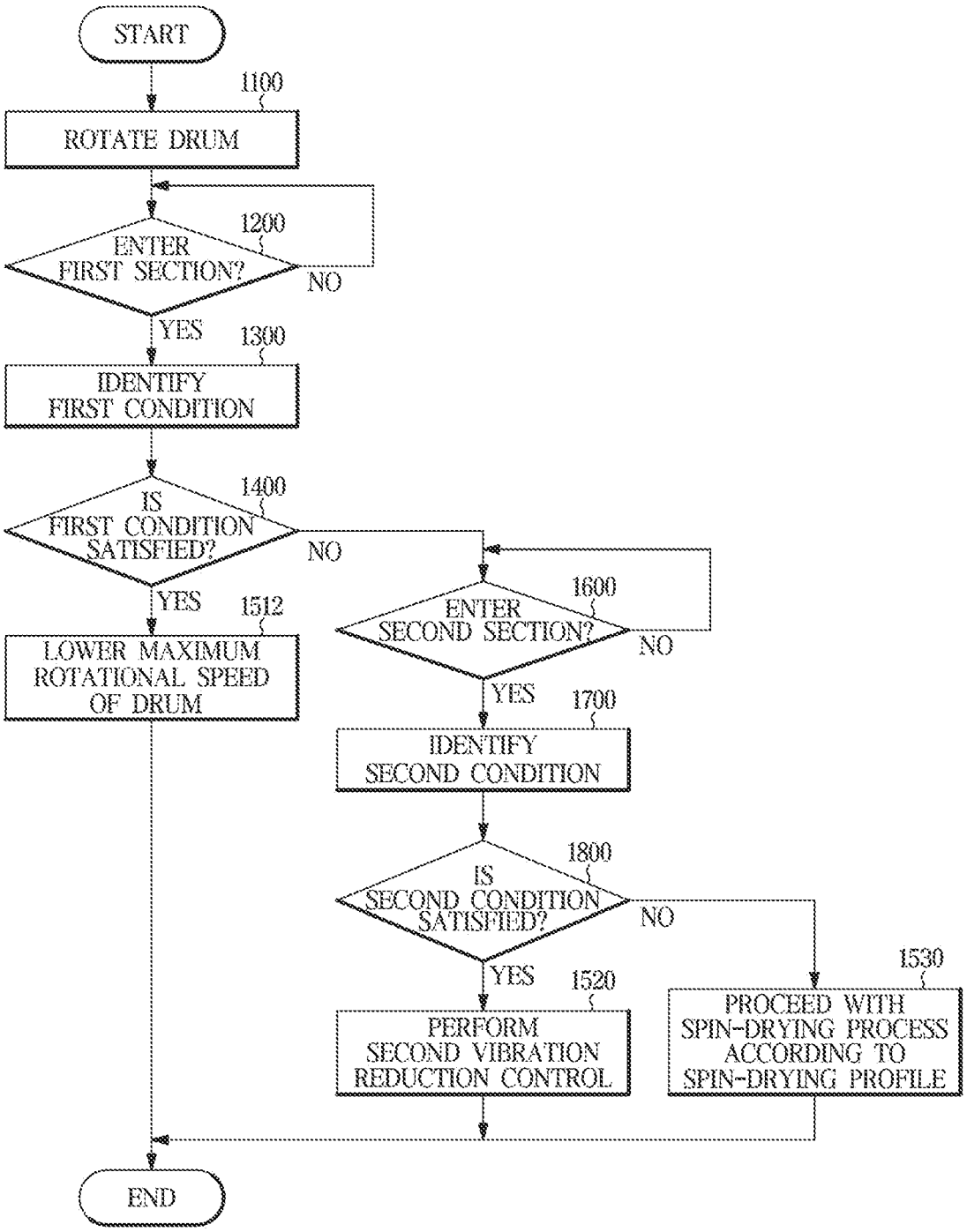
FIG. 16 illustrates a method that specifies a first vibration reduction control within the method of controlling a washing machine according to an embodiment.
Figure 17:
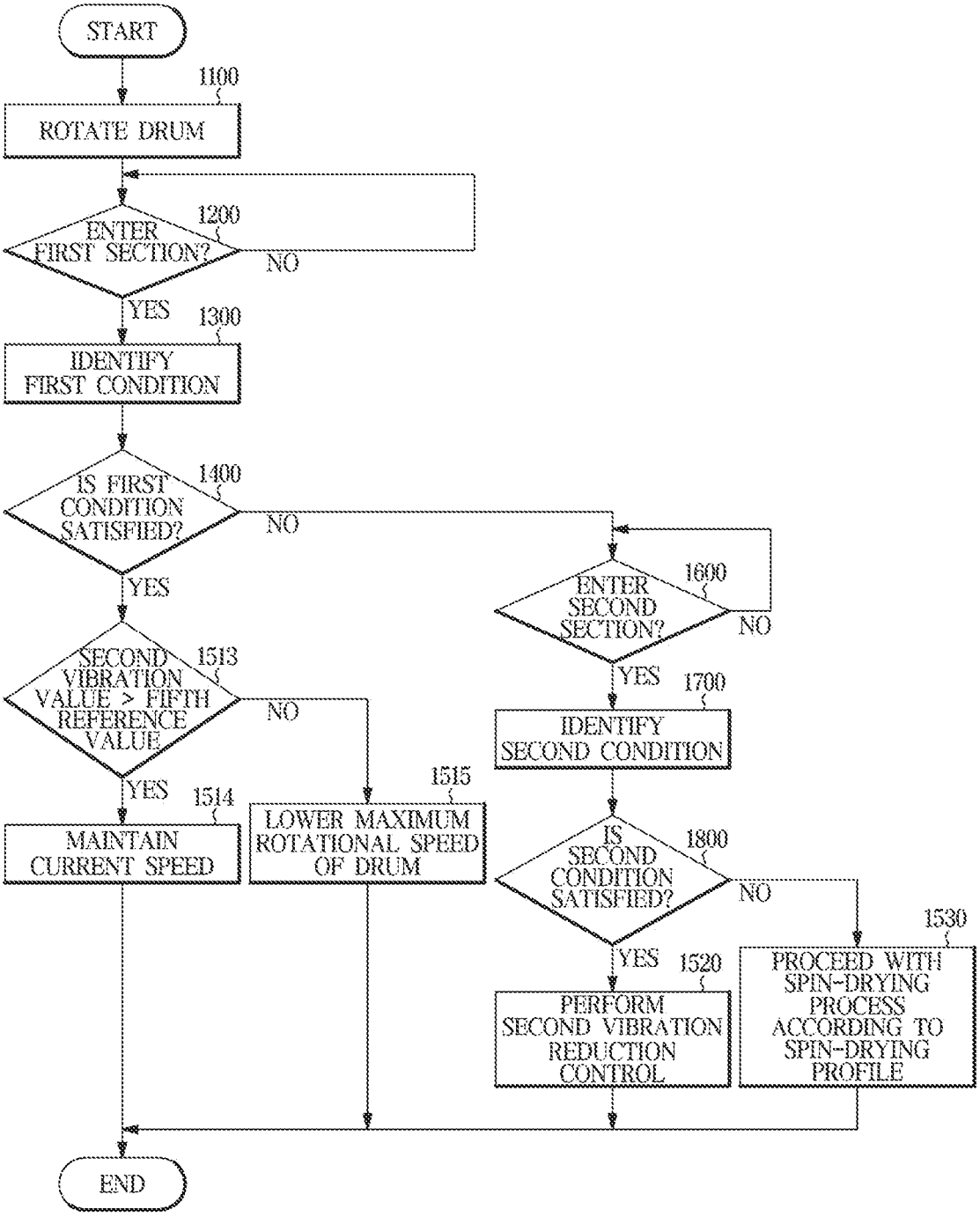
FIG. 17 illustrates a method that specifies a first vibration reduction control within the method of controlling a washing machine according to an embodiment.

FIG. 15 illustrates a method that specifies a first vibration reduction control within the method of controlling a washing machine according to an embodiment. FIG. 16 illustrates a method that specifies a first vibration reduction control within the method of controlling a washing machine according to an embodiment. FIG. 17 illustrates a method that specifies a first vibration reduction control within the method of controlling a washing machine according to an embodiment.

The same operations as those described in FIG. 14 will be omitted.

Referring to FIG. 15, the controller 190 may, based on the first condition being satisfied (YES in operation 1300), maintain the current speed to perform the first vibration reduction control (in operation 1511).

A case in which the first condition is satisfied is when the plurality of legs 104 are in an unbalanced state and thus vibration due to rotation of the drum 130 greatly occurs. In this case, in response to increasing rotational speed of the drum 130, noise due to vibration is expected to increase. Accordingly, the controller 190 may maintain the current rotational speed of the drum 130 without increasing the rotational speed, to reduce vibration.

The controller 190 may maintain the current speed of 500 rpm and terminate spin-drying at the end of the spin-drying process according to the existing spin-drying profile, or may extend the spin-drying time to be longer than that of the existing spin-drying profile. In the latter case, it is possible to prevent of spin-drying performance from declining due to lowering spin-drying speed.

Alternatively, as shown in FIG. 16, the controller 190 may, based on the first condition being satisfied (YES in operation 1300), increase the rotational speed of the drum 130 according to the spin-drying profile while adjusting the maximum rotational speed of the drum 130 to be lower than the maximum rotational speed of the spin-drying profile, to perform the first vibration reduction control (in operation 1512).

Referring to the spin-drying profile of FIG. 4 described above, the drum 130 may rotate at a speed of 500 rpm for a predetermined time, then gradually increase in rotational speed until reaching the maximum speed, and then rotate again for a predetermined time before stopping. Based on the first condition being satisfied, the controller 190 may control the maximum rotational speed of the drum 130 to be lower than the maximum rotational speed specified in the spin-drying profile.

For example, the controller 190 may increase the rotational speed of the drum 130 to 700 rpm instead of 1100 rpm and terminate the spin-drying. Here, the decrease in maximum rotational speed of the drum 130 (e.g., from 1100 rpm to 700 rpm) may be determined in advance, or may be determined based on the first vibration value, or may be determined in consideration of factors, such as the load of laundry.

Alternatively, as shown in FIG. 17, the first vibration reduction control may be differently performed according to the size of the second vibration value.

Specifically, the controller 190 may compare the second vibration value with a fifth reference value, and based on the second vibration value being exceeding the fifth reference value (YES in operation 1513), maintain the current rotational speed of the drum 130 (in operation 1514), and based on the second vibration value being less than or equal to the fifth reference value (NO in operation 1513), increase the rotational speed of the drum 130 while controlling the maximum rotational speed to be lower than the maximum rotational speed on the spin-drying profile (in operation 1515).

Here, the fifth reference value may be determined as a value greater than the second reference value, and may be determined based on experiments, statistics, simulations, or theories.

Figure 18:
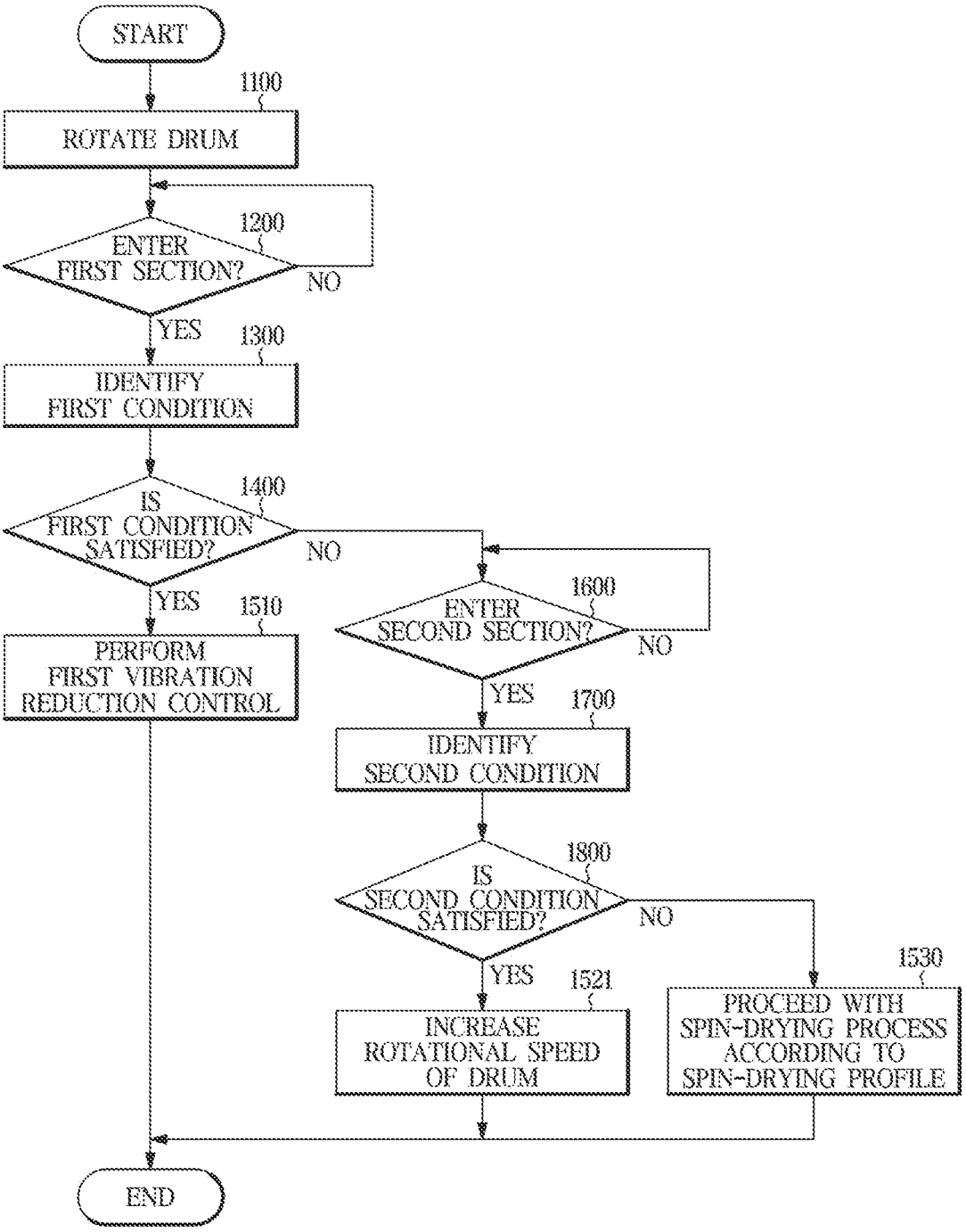
FIG. 18 illustrates a method that specifies a second vibration reduction control within the method of controlling a washing machine according to an embodiment.

FIG. 18 illustrates a method that specifies a second vibration reduction control within the method of controlling a washing machine according to an embodiment.

Referring to FIG. 18, the controller 190 may, based on the second condition being satisfied (YES in operation 1700), increase the rotational speed of the drum 130 to perform the second vibration reduction control (in operation 1521).

A case in which the second condition is satisfied is when the washing machine 100 is disposed on the soft floor, and vibration due to rotation of the drum 130 greatly occurs at a resonance point existing in the range of 700 rpm to 900 rpm. Accordingly, the controller 190 may increase the rotational speed of the drum 130 to be higher than or equal to a threshold value, to escape the resonance range.

When the spin-drying process proceeds according to the spin-drying profile of FIG. 4 described above, the maximum rotational speed of the drum 130 is greater than the threshold value. In this case, the controller 190 may increase the rotational speed of the drum 130 up to the maximum rotational speed at an increase rate (an acceleration) greater than the increase rate (the acceleration) of the spin-drying profile so as to rapidly escape the resonance range.

After reaching the maximum rotational speed, the controller 190 may maintain the maximum rotational speed for a duration time specified in the spin-drying profile and stop rotation of the drum 130. In this case, since the total spin-drying time is reduced while the time during which the drum 130 rotates at the highest rotational speed is maintained, the spin-drying process may be completed in a rapid manner and the vibration reduction effect of the washing machine 100 may be obtained without lowering the spin-drying performance.

Alternatively, the rotation of the drum 130 may be maintained until the ending time of the spin-drying process specified on the spin-drying profile. In this case, since the rotation time of the drum 130 at the highest rotational speed is increased while maintaining the time required for the entire spin-drying process, spin-drying performance may be effectively improved and the vibration reduction effect of the washing machine 100 may be obtained.

In addition, there may be a case in which the maximum rotational speed of the drum 130 is set lower than the threshold value because the spin-drying profile is changed according to the user's selection. In this case, based on the second condition being satisfied, the controller 190 may increase the maximum rotational speed of the drum 130 to be greater than 900 rpm even when the maximum rotational speed of the drum 130 is set to 900 rpm or less.

According to the above-described embodiments of the washing machine and the method of controlling the same, both a sensor for detecting the vibration of the tub and a sensor for detecting the vibration of the cabinet are provided, and the cause of the vibration generated in the washing machine is accurately identified based on the outputs of the sensors.

In addition, appropriate control for the identified cause is performed so that vibration generated in the spin-drying process may be effectively reduced.

The method of controlling the washing machine described above may be stored in a recording medium in which instructions executable by a computer are stored. That is, instructions for performing the method of controlling the washing machine may be stored in a recording medium.

The instructions may be stored in the form of program code and, when executed by a processor, may perform the operations of the disclosed embodiments.

The recording medium may be embodied as a computer-readable recording medium. Here, the recording medium is a non-transitory computer-readable medium that stores data non-temporarily.

The computer-readable recording medium includes all kinds of recording media in which instructions which may be decoded by a computer are stored, for example, a Read Only Memory (ROM), a Random Access Memory (RAM), a magnetic tape, a magnetic disk, a flash memory, an optical data storage device, and the like.

Although embodiments of the disclosure have been described for illustrative purposes, those skilled in the art will appreciate that various modifications, additions and substitutions are possible, without departing from the scope and spirit of the disclosure. Therefore, embodiments of the disclosure have not been described for limiting purposes.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine comprising:

a cabinet that includes an inlet through which laundry is input;

a tub inside the cabinet;

a drum configured to rotate inside the tub;

a motor configured to provide power for rotating the drum;

a first vibration sensor configured to detect vibration generated from the tub;

a second vibration sensor configured to detect vibration generated from the cabinet; and at least one processor configured to;

control rotation of the drum based on a first vibration value corresponding to an output of the first vibration sensor and a second vibration value corresponding to an output of the second vibration sensor during a spin-drying process, compare at least one reference value corresponding to the first vibration value with the second vibration value, and based on the second vibration value exceeding the at least one reference value, control at least one of a rotation speed or a rotation time of the drum to reduce vibration.

2. The washing machine of claim 1, wherein the at least one processor is further configured to perform the spin-drying process according to a spin-dry profile defined by a rotational speed of the drum.

3. The washing machine of claim 2, wherein the at least one processor is further configured to:

compare a first reference value corresponding to the first vibration value with the second vibration value in a first section among a plurality of sections that constitute the spin-dry profile, and based on a determination that the second vibration value exceeds the first reference value, control a maximum rotational speed of the drum during the spin-drying process to be less than a maximum rotation speed based on the spin-dry profile.

4. The washing machine of claim 2, wherein the at least one processor is further configured to:

compare a first reference value corresponding to the first vibration value with the second vibration value in a first section among a plurality of sections that constitute the spin-dry profile; and based on the second vibration value exceeding the first reference value, maintain the rotational speed of the drum at a current rotation speed.

5. The washing machine of claim 2, wherein the at least one processor is further configured to:

compare a second reference value corresponding to the first vibration value with the second vibration value in a second section among a plurality of sections that constitute the spin-dry profile; and based on the second vibration value exceeding the second reference value, increase the rotational speed of the drum to be higher than or equal to a threshold value.

6. The washing machine of claim 2, further comprising a plurality of legs on a lower side of the cabinet to support the cabinet, wherein the at least one processor is further configured to:

compare a first reference value corresponding to the first vibration value with the second vibration value in a first section among a plurality of sections that constitute the spin-dry profile; and based on the second vibration value exceeding the first reference value, identify that the plurality of legs are in an unbalanced state.

7. The washing machine of claim 2, wherein at least one processor is further configured to:

compare a second reference value corresponding to the first vibration value with the second vibration value in a second section among a plurality of sections that constitute the spin-dry profile; and based on the second vibration value exceeding the second reference value, identify that a floor on which the washing machine is located is a soft floor.

8. The washing machine of claim 2, wherein the at least one processor is further configured to:

compare a first reference value corresponding to the first vibration value with the second vibration value in a first section among a plurality of sections that constitute the spin-dry profile; and based on the second vibration value exceeding the first reference value and being less than or equal to a fifth reference value, control a maximum rotational speed of the drum during the spin-drying process to be less than a maximum rotation speed according to the spin-dry profile.

9. The washing machine of claim 8, wherein the at least one processor is further configured to:

compare a first reference value corresponding to the first vibration value with the second vibration value in a first section among a plurality of sections that constitute the spin dry profile; and based on the second vibration value exceeding the fifth reference value, maintain the rotational speed of the drum at a current rotation speed and then terminate the spin-drying process.

10. The washing machine of claim 1, wherein at least one of the first vibration sensor or the second vibration sensor comprises a MicroElectroMechanical System (MEMS) sensor.

* * * * *